US012698696B2

(12) United States Patent
Crumpton et al.

(10) Patent No.: US 12,698,696 B2
(45) Date of Patent: Aug. 4, 2026

(54) METHOD AND SYSTEM FOR PERFORMING RESERVOIR SIMULATIONS USING LOOK-AHEAD MODELS

(71) Applicant: SAUDI ARABIAN OIL COMPANY, Dhahran (SA)

(72) Inventors: Paul Crumpton, Dhahran (SA); Michel Cancelliere, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 1148 days.

(21) Appl. No.: 17/720,826

(22) Filed: Apr. 14, 2022

(65) Prior Publication Data

US 2023/0332490 A1 Oct. 19, 2023

(51) Int. Cl.
*E21B 43/16* (2006.01)

(52) U.S. Cl.
CPC ..... *E21B 43/16* (2013.01); *E21B 2200/20* (2020.05)

(58) Field of Classification Search
None
See application file for complete search history.

(56) References Cited

U.S. PATENT DOCUMENTS

2013/0226540 A1 8/2013 Pita
2018/0066501 A1* 3/2018 Chidiac ..... G06F 30/20
2020/0226311 A1* 7/2020 Ding ..... G01V 20/00
2021/0238971 A1 8/2021 Crumpton
2021/0405248 A1 12/2021 Cancelliere et al.
2021/0405249 A1 12/2021 Kayum et al.

OTHER PUBLICATIONS

D.Y. Ding et al., "Coupled simulation of near-wellbore and reservoir models," Journal of Petroleum Science and Engineering, No. 76, pp. 21-36, 2011 (16 pages).
International Search Report issued in corresponding International Application No. PCT/US2023/018637; mailed Jul. 10, 2023 (6 pages).
Written Opinion of the International Searching Authority issued in corresponding International Application No. PCT/US2023/018637; mailed Jul. 10, 2023 (9 pages).
(Continued)

*Primary Examiner* — Renee D Chavez
(74) *Attorney, Agent, or Firm* — Osha Bergman Watanabe & Burton LLP

(57) ABSTRACT

A method may include obtaining grid model data regarding a geological region of interest. The method may further include obtaining well data regarding a well in the geological region of interest. The method may further include obtaining a grid model for the geological region of interest based on the grid model data and the well data. The method may further include obtaining a time selection for a look-ahead simulation. The method may further include determining a look-ahead model for the look-ahead simulation based on the grid model data, the well data, and a coarsening function. The method may further include performing the look-ahead simulation using the look-ahead model and the time selection. The method may further include performing a reservoir simulation of the geological region of interest using the grid model and the look-ahead simulation.

15 Claims, 16 Drawing Sheets

(56) References Cited

OTHER PUBLICATIONS

Dogru, Ali H. et al., "From Mega-Cell to Giga-Cell Reservoir Simulation"; Proceedings of the 2008 SPE Annual Technical Conference and Exhibition; Paper No. SPE-116675-MS; pp. 1-19; Sep. 21, 2008 (19 pages).
Dogru, Ali H. et al., "New Frontiers in Large Scale Reservoir Simulation"; Proceedings of the SPE Reservoir Simulation Symposium; Paper No. SPE-142297-MS; pp. 1-12; Feb. 21, 2011 (12 pages).
Elfeel, Mohamed Ahmed et al., "Efficient Optimization of Field Management Strategies in Reservoir Simulation"; Proceedings of the SPE Reservoir Characterisation and Simulation Conference and Exhibition; Paper No. SPE-196662-MS; pp. 1-13; Sep. 17, 2019 (13 pages).
Wikipedia, "Reservoir simulation"; <https://en.wikipedia.org/wiki/Reservoir_simulation>; Accessed Mar. 22, 2022 (7 pages).

* cited by examiner

METHOD AND SYSTEM FOR PERFORMING RESERVOIR SIMULATIONS USING LOOK-AHEAD MODELS

BACKGROUND

In a coarsened model, properties for various cells may be averaged in a process called upscaling. However, if not applied properly, up scaling may provide a solution in the coarsened model that may lose accuracy as details are lost in the averaging process, especially where coarsening is applied to highly influential grid cells. Thus, accurate simulations may require a coarsened model that reduces the computational time to a reasonable speed while also preserving relevant physical relationships in the underlying data.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining grid model data regarding a geological region of interest. The method further includes obtaining well data regarding a well in the geological region of interest. The method further includes obtaining a grid model for the geological region of interest based on the grid model data and the well data. The method further includes obtaining a time selection for a look-ahead simulation. The method further includes determining, by a computer processor, a look-ahead model for the look-ahead simulation based on the grid model data, the well data, and a coarsening function. The look-ahead model simulates the geological region of interest at a faster rate than the grid model. The method further includes performing, by the computer processor, the look-ahead simulation using the look-ahead model and the time selection. The method further includes performing, by the computer processor, a reservoir simulation of the geological region of interest using the grid model and the look-ahead simulation.

In general, in one aspect, embodiments relate to a system that includes a network, which includes various parallel processors. The system further includes a reservoir simulator that includes a computer processor. The reservoir simulator is coupled to the network. The reservoir simulator obtains grid model data regarding a geological region of interest. The reservoir simulator obtains well data regarding a well in the geological region of interest. The reservoir simulator obtains a grid model for the geological region of interest based on the grid model data and the well data. The reservoir simulator obtains a time selection for a look-ahead simulation. The reservoir simulator determines a look-ahead model for the look-ahead simulation based on the grid model data, the well data, and a coarsening function. The look-ahead model simulates the geological region of interest at a faster rate than the grid model. The reservoir simulator performs the look-ahead simulation using the look-ahead model and the time selection. The reservoir simulator performs a reservoir simulation of the geological region of interest using the grid model and the look-ahead simulation.

In general, in one aspect, embodiments relate to a non-transitory computer readable medium storing instructions executable by a computer processor. The instructions obtain grid model data regarding a geological region of interest. The instructions obtain well data regarding a well in the geological region of interest. The instructions obtain a grid model for the geological region of interest based on the grid model data and the well data. The instructions obtain a time selection for a look-ahead simulation. The instructions determine a look-ahead model for the look-ahead simulation based on the grid model data, the well data, and a coarsening function. The look-ahead model simulates the geological region of interest at a faster rate than the grid model. The instructions perform the look-ahead simulation using the look-ahead model and the time selection. The instructions perform a reservoir simulation of the geological region of interest using the grid model and the look-ahead simulation.

In some embodiments, look-ahead data are determined based on a look-ahead simulation. A composite reservoir parameter may be determined based on well data and the look-ahead data, where the composite reservoir parameter is based on a reservoir parameter from the look-ahead simulation and a second reservoir simulation that is performed before another reservoir simulation. The first reservoir simulation may be performed using the composite reservoir parameter. In some embodiments, the composite reservoir parameter includes a weighted value based on a number of look-ahead. In some embodiments, a first well potential for various wells in a geological region of interest are determined at a time step in an iterative process. A second well potential is determined for the wells using a look-ahead simulation. The first well potential may describe a simulated production rate for the wells for the first time step, and the second well potential may describe a simulated production rate for the wells over the time selection. A composite well potential may be determined based on the first well potential and the second well potential, where a reservoir simulation is performed using the composite well potential.

In some embodiments, various look-ahead models are determined for various wells in the geological region of interest. A respective look-ahead model among the look-ahead models may correspond to a respective well among the wells. The respective look-ahead model may include an area of interest around the respective well, and the respective look-ahead model may include a first subset of cells outside the area of interest with greater coarsening than a second subset of cells within the area of interest. A second reservoir simulation may be performed based on various look-ahead simulations using the look-ahead models. In some embodiments, a geological region of interest is simulated using various reservoir simulations including a first reservoir simulation, wherein simulating the geological region of interest corresponds to a predetermined time period. The time selection may be a subset of the predetermined time period that is less than the predetermined time period. In some embodiments, a time selection includes a target time, where the target time may correspond to a predetermined time step in an iterative process where the first look-ahead simulation ends. A reservoir simulation may continue in the iterative process past the predetermined time step. In some embodiments, a reservoir simulation and a look-ahead simulation are performed in parallel using various parallel processors. In some embodiments, a look-ahead simulation is performed before beginning a particular reservoir simulation. In some embodiments, a look-ahead model is determined for a look-ahead simulation based on grid model data, well data, and a coarsening function. A first look-ahead simulation may be performed in parallel with a second look-ahead simulation using the look-ahead models and a time selection, wherein first coarsening function and the second coarsening functions are different functions for the different look-ahead models.

In some embodiments, a coarsening function is selected from a group consisting of a fluid characterization coarsening, a streamline coarsening, or a grid coarsening. In some embodiments, a look-ahead model is a proxy model that includes various well constraints that are the same as the well constraints in the grid model. The proxy model may have a number of grid cells that are less than the number of grid cells in the grid model. In some embodiments, a network is a parallel cluster that includes various graphical processing units (GPUs). The network may perform multiple reservoir simulations and/or look-ahead simulations in parallel or sequentially.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
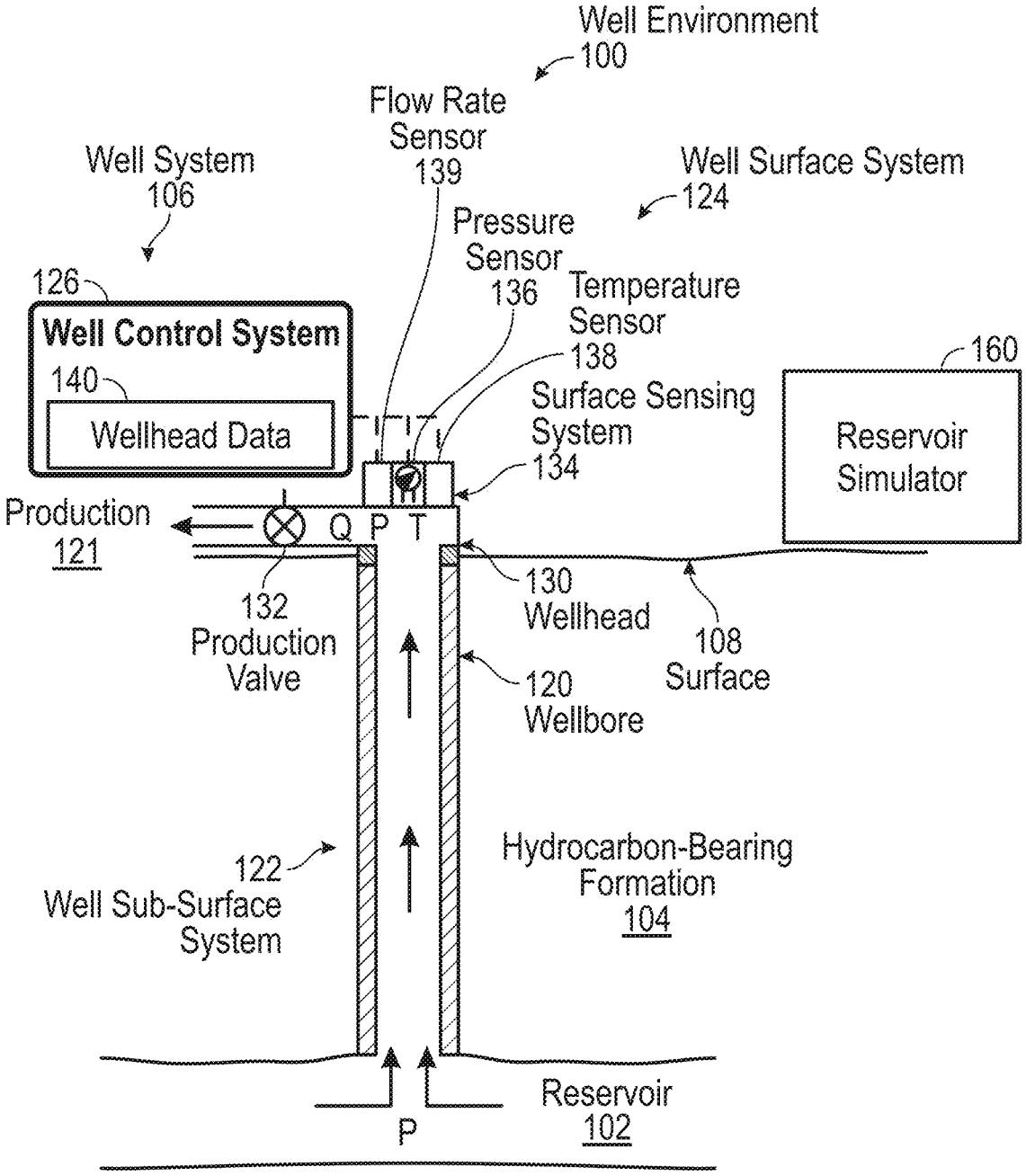
FIGS. 1, 2A, 2B, and 3 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for using look-ahead models in conjunction with a grid model to perform a reservoir simulation. In some embodiments, for example, a look-ahead model is a proxy model that may be a coarsened version of a main grid model. By performing at a faster computing speed than the main grid model, the look-ahead model may simulate one or more time periods beyond the current simulation time of a main reservoir simulation. Thus, smaller look-ahead simulations may be used to optimize the larger reservoir simulation based on parallel processing. Accordingly, look-ahead simulations may predict reservoir parameters at later times in the main reservoir simulation in order to provide valuable information to guide the more accurate (but slower) simulation run. As such, results from look-ahead simulations may be harvested by the main grid model to optimize the reservoir simulation, e.g., by producing composite reservoir parameters based on the output of both look-ahead simulations and the current state of the main reservoir simulation.

Moreover, a reservoir simulation using a grid model may be divided into multiple underlying reservoir simulations using input parameters based on different look-ahead simulations. While an initial time period (e.g., 0-1 years) of the main reservoir simulation may only use a larger grid model, later time periods in the main reservoir simulation may use one or more look-ahead simulations to fine-tune input parameters for those time periods. In a twenty year reservoir simulation, a look-ahead simulation may be performed for five years into the simulation's future in parallel with a much shorter time period being simulated based on the main grid model. After completion of the look-ahead simulation, the current set of input parameters to the main reservoir simulation may be adjusted, while another set of look-ahead simulations may be initiated using the adjusted input parameters.

In some embodiments, look-ahead models are used as part of an iterative process and generated on-the-fly during a simulation run for a fraction of the total simulation time. Using different time selections, for example, look-ahead models may predict the state of different simulation parameters at different target times later in the current reservoir simulation, such as well production states, reservoir states, the number of open and shut-in wells, etc. By having advanced knowledge of time periods later in the main reservoir simulation, a reservoir simulator may optimize the reservoir simulation at its current time state.

Turning to FIG. 1, FIG. 1 shows a schematic diagram in accordance with one or more embodiments. As shown in FIG. 1, FIG. 1 illustrates a well environment (100) that includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying properties, such as varying degrees of permeability, porosity, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (902) described below in FIG. 9 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) ($Q_{wh}$) passing through the wellhead (130).

In some embodiments, the well system (106) includes a reservoir simulator (160). For example, the reservoir simulator (160) may include hardware and/or software with functionality for generating one or more reservoir models regarding the hydrocarbon-bearing formation (104) and/or performing one or more reservoir simulations. For example, the reservoir simulator (160) may store well logs and data regarding core samples for performing simulations. A reservoir simulator may further analyze the well log data, the core sample data, seismic data, and/or other types of data to generate and/or update the one or more reservoir models. While the reservoir simulator (160) is shown at a well site, embodiments are contemplated where reservoir simulators are located away from well sites. In some embodiments, the reservoir simulator (160) may include a computer system that is similar to the computer system (902) described below with regard to FIG. 9 and the accompanying description.

In some embodiments, production wells and/or injection wells are used in one or more stimulation operations. For example, one type of stimulation operation is a water-alternating-gas (WAG) operation. A WAG operation may be a cyclic process of injecting water followed by gas. Using a WAG injection, macroscopic or microscopic sweep efficiency may be improved for a reservoir, e.g., by maintaining nearly initial high pressure, slow down any gas breakthroughs, and reduce oil viscosity. Likewise, WAG injections may also decrease residual oil saturation resulting from three phase flows and effects associated with relative permeability hysteresis. Thus, some stimulation operations may produce gas flooding, which is a type of enhanced oil recovery (EOR) method for increasing recovery of light to moderate oil reservoirs. In some stimulation operations, water may be injected during the initial phase of the operation and followed by a gas (e.g., carbon dioxide) because water may have a higher mobility ratio than the injected gas, thereby preventing breakthroughs in the reservoir. Injected gas may be a mixture of hydrocarbon gas or nonhydrocarbon gases. With hydrocarbon gases, the gas mixture may include methane, ethane, and propane for achieving a miscible or immiscible gas-oil system in the reservoir. With nonhydrocarbon gases, the gas mixture may include carbon dioxide ($CO_2$), nitrogen ($N_2$), and some exotic gases that displace fluid in the reservoir. Likewise, gas may also be injected directly into a reservoir, e.g., into the gas cap, to compensate for the reservoir's pressure decline.

Furthermore, a stimulation injection during a stimulation operation may correspond to various injection parameters, such as bank size, cycle time, and a predetermined water-gas ratio (also called a "WAG ratio"). Bank size may refer to a size of sequential banks of fluids (e.g., oil, $CO_2$ and water) formed in the reservoir rock in response to a stimulation operation that migrate from the injection to the production wells. For illustration, a WAG ratio of 1:1 may result in a high oil production for one or more production wells, such as production wells coupled to a miscible reservoir. Based on some reservoir parameters such as oil composition, gas flooding can be carried out in miscible or immiscible conditions. Moreover, different types of stimulation operations may use different stimulation parameters. Examples of different stimulation operations may include: (1) continuous gas injections; (2) WAG injections; (3) simultaneous water-alternating-gas (SWAG) injections; and (4) tapered WAG injections. Different strategies have been developed by the petroleum industry to cope with these conditions.

Figure 2A:
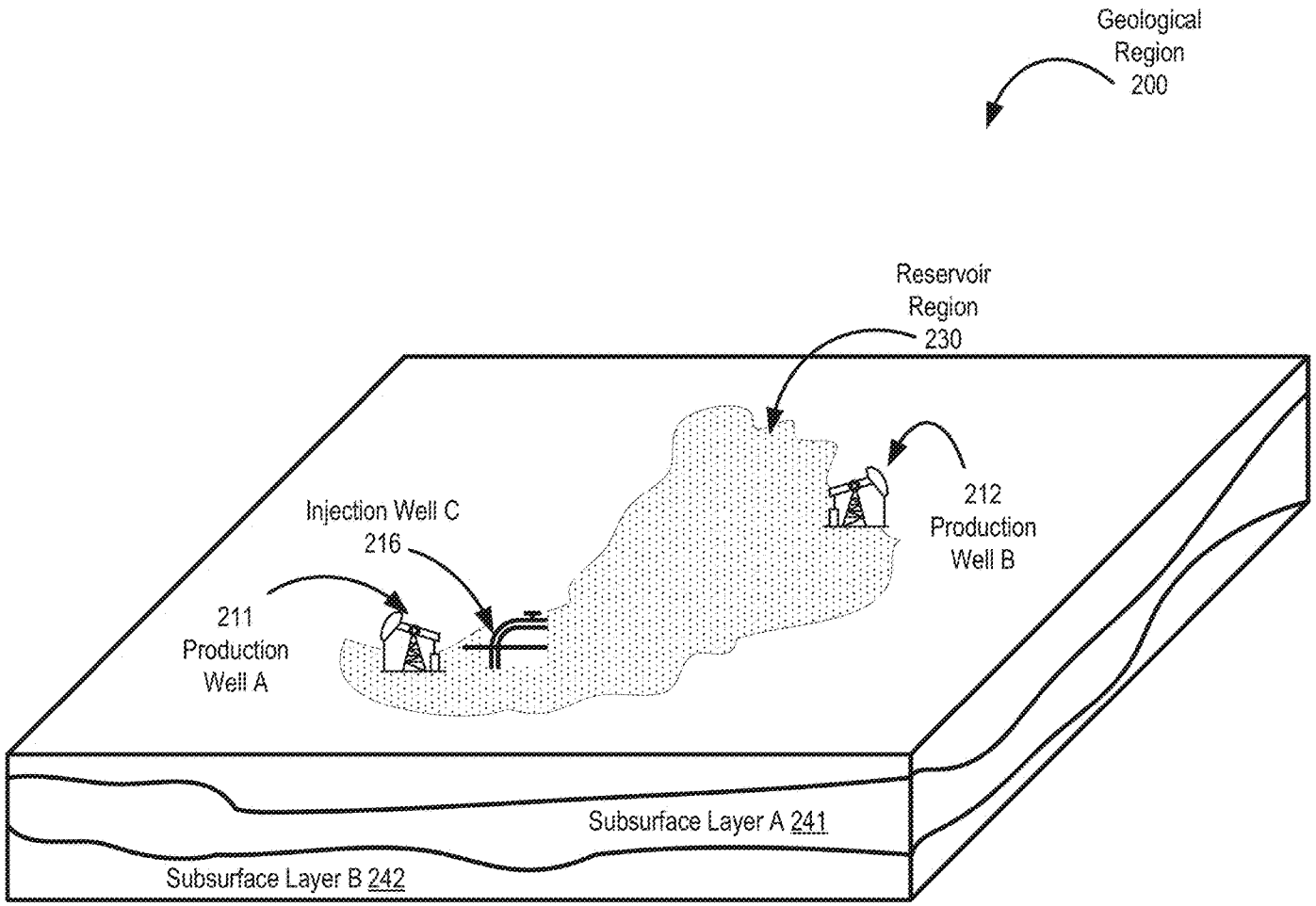

Turning to FIG. 2A, FIG. 2A shows a schematic diagram in accordance with one or more embodiments. As illustrated in FIG. 2A, FIG. 2A shows a geological region (200) that may include one or more reservoir regions (e.g., reservoir region (230)) with various production wells (e.g., production well A (211), production well (212)). For example, a production well may be similar to the well system (106) described above in FIG. 1 and the accompanying description. Likewise, a reservoir region may also include one or more injection wells (e.g., injection well C (216)) that include functionality for enhancing production by one or more neighboring production wells. As shown in FIG. 2A, wells may be disposed in the reservoir region (230) above various subsurface layers (e.g., subsurface layer A (241), subsurface layer B (242)), which may include hydrocarbon deposits. In particular, production data and/or injection data may exist for a particular well, where production data may include data that describes production or production operations at a well, such as wellhead data (140) described in FIG. 1 and the accompanying description.

Figure 2B:
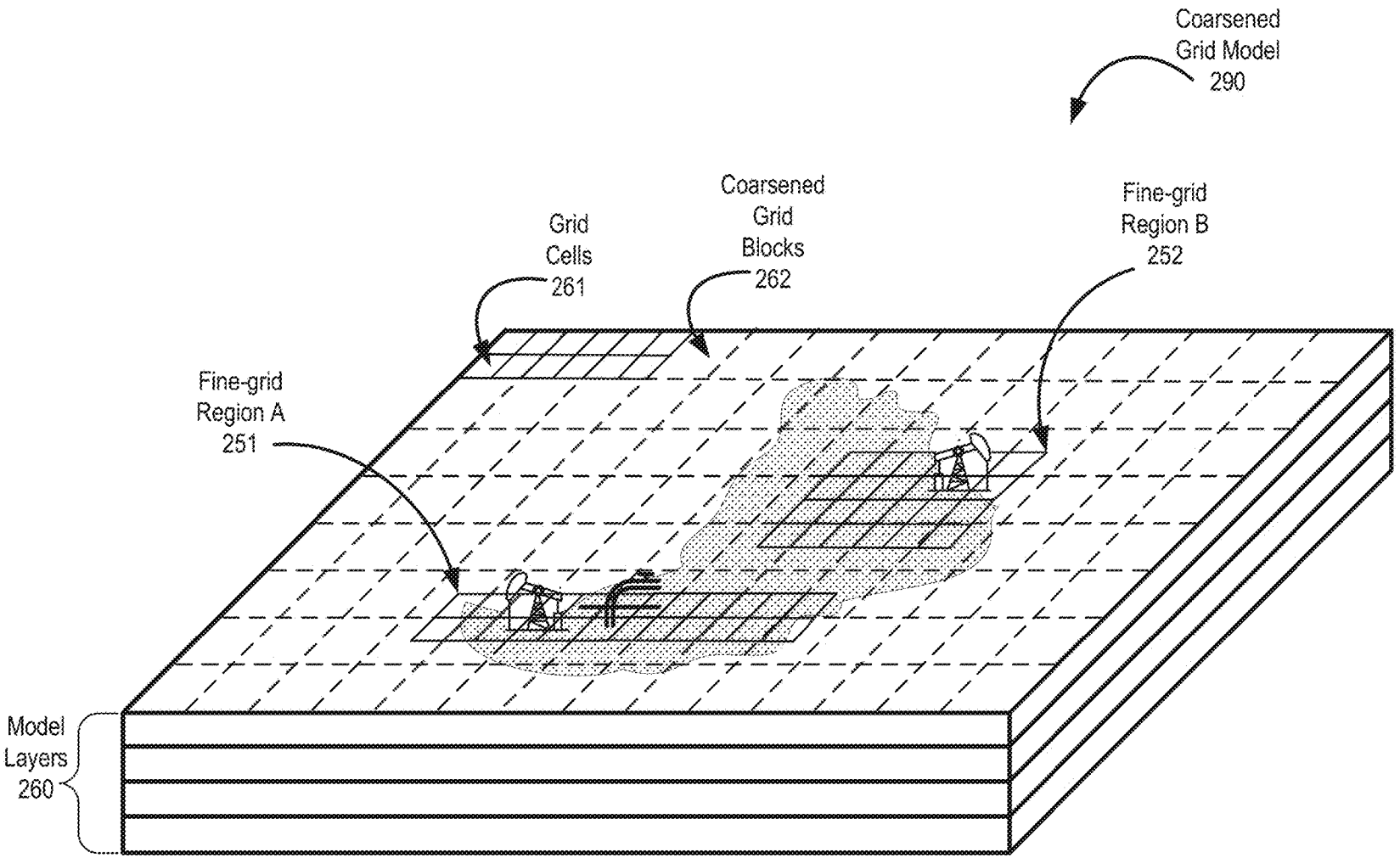

Turning to FIG. 2B, FIG. 2B shows a schematic diagram in accordance with one or more embodiments. As illustrated in FIG. 2B, FIG. 2B shows a coarsened grid model (290) that corresponds to the geological region (200) from FIG. 2A. More specifically, the coarsened grid model (290) includes grid cells (261) that may refer to an original cell of a grid model as well as coarsened grid blocks (262) that may refer to an amalgamation of original cells of the grid model. For example, a grid cell may be the case of a 1×1 block, where coarsened grid blocks may be of sizes 2×2, 4×4, 8×8, etc. Both the grid cells (261) and the coarsened grid blocks (262) may correspond to columns for multiple model layers (260) within the coarsened grid model (290).

Prior to performing a reservoir simulation, local grid refinement and coarsening (LGR) may be used to increase or decrease grid resolutions in various regions of a grid model. For example, various reservoir properties, e.g., permeability, porosity, or saturations, may correspond to discrete values that are associated with a particular grid cell or coarsened grid block. However, by using discrete values to represent a portion of a geological region, a discretization error may occur in a reservoir simulation. Thus, various fine-grid regions may reduce discretization errors as the numerical approximation of a finer grid is closer to the exact solution, however through a higher computational cost. As shown in FIG. 2B, for example, the coarsened grid model (290) may include various fine-grid regions (i.e., fine-grid region A (251), fine-grid region B (252)), that are surrounded by coarsened block regions. Likewise, the original grid model without any coarsening may be referred to as a fine-grid model.

In general, coarsening may be applied to cells that do not contribute to a total flow within a reservoir region because a slight change on such reservoir properties may not affect the output of a simulation. Accordingly, different levels of coarsening may be used on different regions of the same reservoir model. As such, a coarsening ratio may correspond to a measure of coarsening efficiency, which may be defined as a total number of cells in a coarsened reservoir model divided by the original number of cells in the original reservoir model.

In some embodiments, a reservoir simulator uses a multilevel mask to label original cells in a grid model according to their respective coarsening or refinement levels for generating a particular coarsened grid model. In particular, these labels may correspond to various coarsening levels for original cells. In some embodiments, a multilevel mask is generated from multiple binary masks that specify areas where refinement or coarsening is desired in a grid model. A binary mask may be an image or other dataset that is defined according to '1' and '0's, or any other binary integer set. For example, a '1' in a binary mask may correspond to a coarsening level of 8×8 cells for the respective coarsened grid block, while a '0' identifies a cell or block that is left unchanged during the respective coarsening step.

In some embodiments, one or more coarsening functions are used to produce a coarsened-grid model. In particular, a coarsening function may be based on one or more fluid characterizations (e.g., to produce a proxy model with less rigorous fluid characterization), streamlines, or any other criterion that may provide a satisfactory estimate of future reservoir performance within a geological region. In order to reduce computational time, a coarsened grid model may be generated by coarsening cells that do not contribute to a total flow of a reservoir region, because a slight change on reservoir properties, i.e. permeability, porosity or saturations, may impact reservoir simulations. Accordingly, a coarsening function may be based on various flow properties of a reservoir region of interest.

For a coarsening function based on streamlines, for example, streamlines may be field lines instantaneously tangent to a fluid velocity field that provide a representation of reservoir connectivity. As such, streamlines may be an alternative to cell-based grid modeling techniques in reservoir simulations, where a streamline output from a reservoir simulator may include a snapshot of an instantaneous flow field in a geological region. Likewise, individual streamlines may describe flow properties of a production well or an injection well. As such, a reservoir simulator may transform a reservoir grid model into a number of flow paths of nominally constant flux to produce a particular proxy model or other type of coarsened-grid model.

Figure 3:
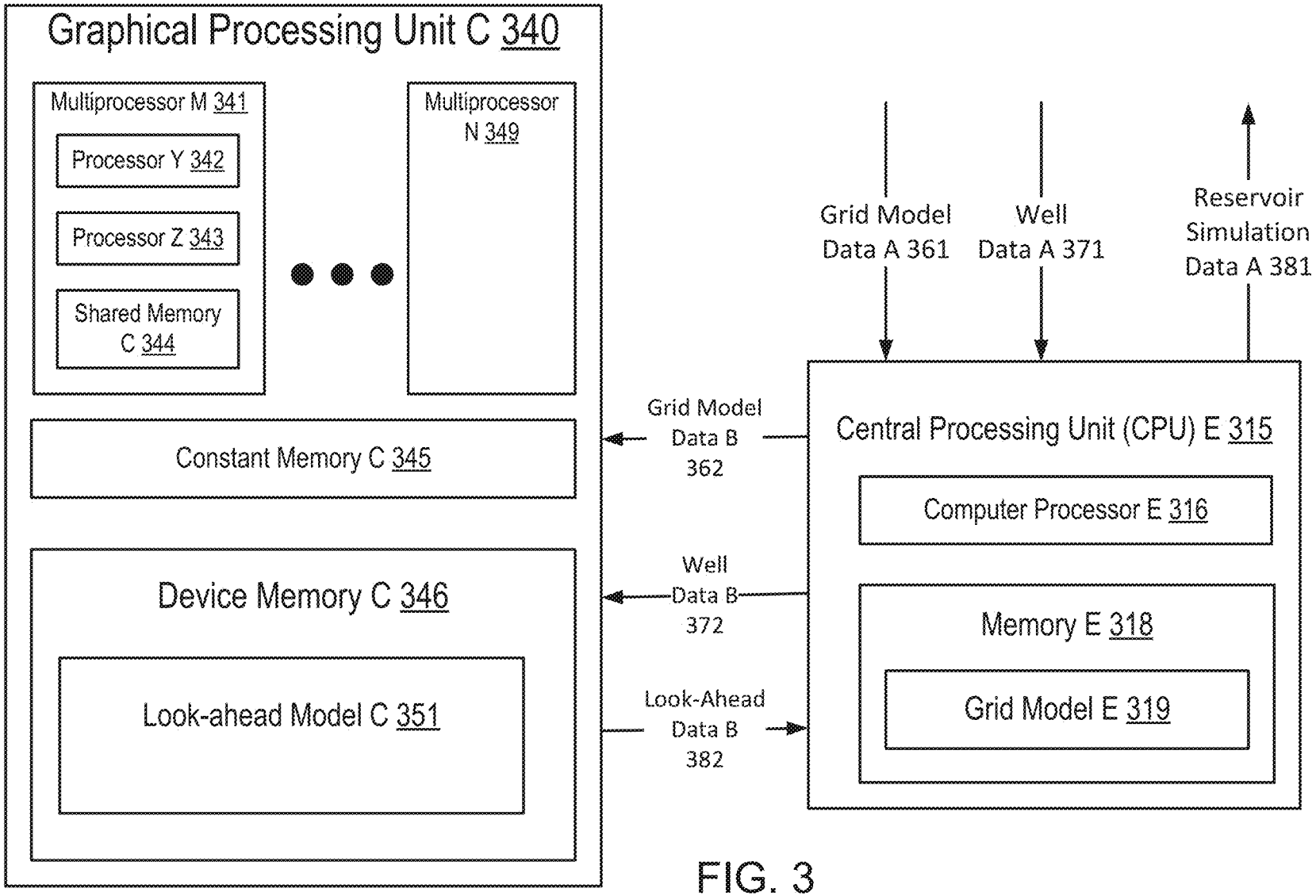

Turning to FIG. 3, FIG. 3 shows a schematic diagram in accordance with one or more embodiments. As illustrated in FIG. 3, a central processing unit (CPU) (e.g., CPU E (315)) may be coupled to one or more graphical processing units (e.g., graphical processing unit (GPU) C (340)) to perform one or more reservoir simulation operations. In particular, a GPU may include various hardware, such as a set of multiprocessors (e.g., multiprocessor M (341), multiprocessor N (349)), where a respective multiprocessor may include multiple individual processors (e.g., processor Y (342), processor Z (343), which may be referred to as "cores"), and one or more shared memories (e.g., shared memory C (344)). As such, a GPU may perform a specific portion of a simulation operation that may be referred to as a "kernel" that is performed using multiple hardware threads operating in parallel. For example, a GPU may execute the kernel using one or more thread blocks, where a thread block includes a group of single instruction, multiple data (SIMD) threads. As such, multiple thread blocks may be executed by a single multiprocessor concurrently on a GPU. Thus, GPUs may include functionality for accelerating image generation, which may also make GPUs suitable hardware for executing parallel processing in order to perform reservoir simulations and look-ahead simulations that include complex computations. A processor may be a parallel processor and similar to the processor (905) described below in FIG. 9 and the accompanying description.

In some embodiments, a reservoir simulator is the CPU and uses one or more GPUs (e.g., GPU C (340)) to determine look-ahead data (e.g., look-ahead data A (382)) and reservoir simulation data (e.g., reservoir simulation data A (381)) within an iterative reservoir simulation algorithm. In regard to CPU E (315), for example, the CPU E (315) includes a computer processor E (316) and a memory E (318) that stores a grid model E (319) for performing a reservoir simulation. As such, the CPU E (315) may transmit a portion of grid model data A (361) to the GPU C (340) or to another GPU, e.g., as a portion of coarsened grid model data that is used to construct a look-ahead model (e.g., look-ahead model C (351)). After collecting look-ahead data from the GPUs performing the reservoir simulation algorithm, the CPU E (315) may transmit the results to an external source for storage and/or analysis.

In some embodiments, a GPU performs a look-ahead simulation using a look-ahead model (e.g., look-ahead model C (351)). For example, the look-ahead model C (351) may be a grid model coarsened using one or more coarsening functions and based on the original grid model data (e.g., grid model data B (362) and well data (e.g., well data B (372)). For example, the grid model data B (362) obtained by GPU C (340) and well data B (372) may be a portion of the grid model data A (361) and well data A (371) received by the CPU E (315), respectively. While the CPU E (315) or another GPU may perform a reservoir simulation for one or more time steps using the grid model E (319), the GPU C (340) may perform a look-ahead simulation in parallel using one of its processors (e.g., processor Y (342), processor Z (343)).

Furthermore, a grid model may be a giant multi-million cell model that may require a long simulation period, while a look-ahead model may be a proxy model that simulates a period of time faster than the grid model. For example, a look-ahead model may have a simulation speed that is ten times or more faster than a main grid model. As such, a look-ahead model may use less computer resources (e.g., 5× less processing power) than simulations with a grid model. Furthermore, look-ahead models may be coarsened or upscaled versions of the original grid model. For example, a look-ahead model may have selectively less grid cells or a reduced number of model components.

In some embodiments, a look-ahead model includes the same well requirements for one or more wells that are being simulated by a main grid model. For example, a grid model and one or more look-ahead models may have similar well rules, well facility constraints, and production targets while other reservoir parameters may be coarsened or simplified in the look-ahead model. Thus, a perturbation of a grid model may be reflected in the respective look-ahead model. Accordingly, look-ahead models may be used to guide and optimize the grid model based on a particular time selection (e.g., time period being simulated using a look-ahead model).

Returning to GPUs, a GPU may include different types of memory hardware, such as register memory, shared memory, device memory, constant memory, texture memory, etc. For example, register memory and shared memory (e.g., shared memory C (344)) may be disposed on an actual GPU chip, while other types of memory may be separate components in the GPU. In particular, register memory may only be accessible to the hardware thread that wrote its memory values, which may only last throughout the respective thread's lifetime. On the other hand, shared memory may be accessible to all hardware threads within a thread block and shared memory values may exist for the duration of the thread block (e.g., shared memory enables hardware threads to communicate and share data between one another). Device memory (e.g., device memory C (346)) may be global memory that is accessible to any hardware threads within a GPU's application as well as devices outside the GPU, such as a reservoir simulator. Device memory may be allocated by a host for example, and may survive until the host deallocates the memory. Constant memory (e.g., constant memory C (345)) may be a read-only memory device that provides memory values that do not change over the course of a kernel execution (e.g., constant memory may provide data faster than device memory and thus reduce memory bandwidth). Texture memory (not shown) may be another read-only memory device that is similar to constant memory, where the memory reads in texture memory may be limited to physically adjacent hardware threads, e.g., those hardware threads in a warp.

In some embodiments, multiple GPUs, a central processing unit, and/or one or more reservoir simulators may communicate with each other using a peer-to-peer (P2P) communication protocol. For example, two GPUs may be attached to the same PCIe bus in a reservoir simulator and communicate directly with each other. Thus, over a P2P communication protocol, a component in a reservoir simulator may access a different memory in another GPU or CPU. In some embodiments, for example, the CPU E (315) may not store locally the look-ahead data B (382), but may simply access the device memory C (346) in the GPU C (340) that stores a portion of the look-ahead data B (382). Likewise, the P2P communication protocol may also enable direct memory transfers between system components, e.g., to distribute grid model data and/or well data among multiple GPUs.

While FIGS. 1, 2A, 2B, and 3 show various configurations of components, other configurations may be used without departing from the scope of the disclosure. For example, various components in FIGS. 1, 2A, 2B, and 3 may be combined to create a single component. As another example, the functionality performed by a single component may be performed by two or more components.

Figure 4:
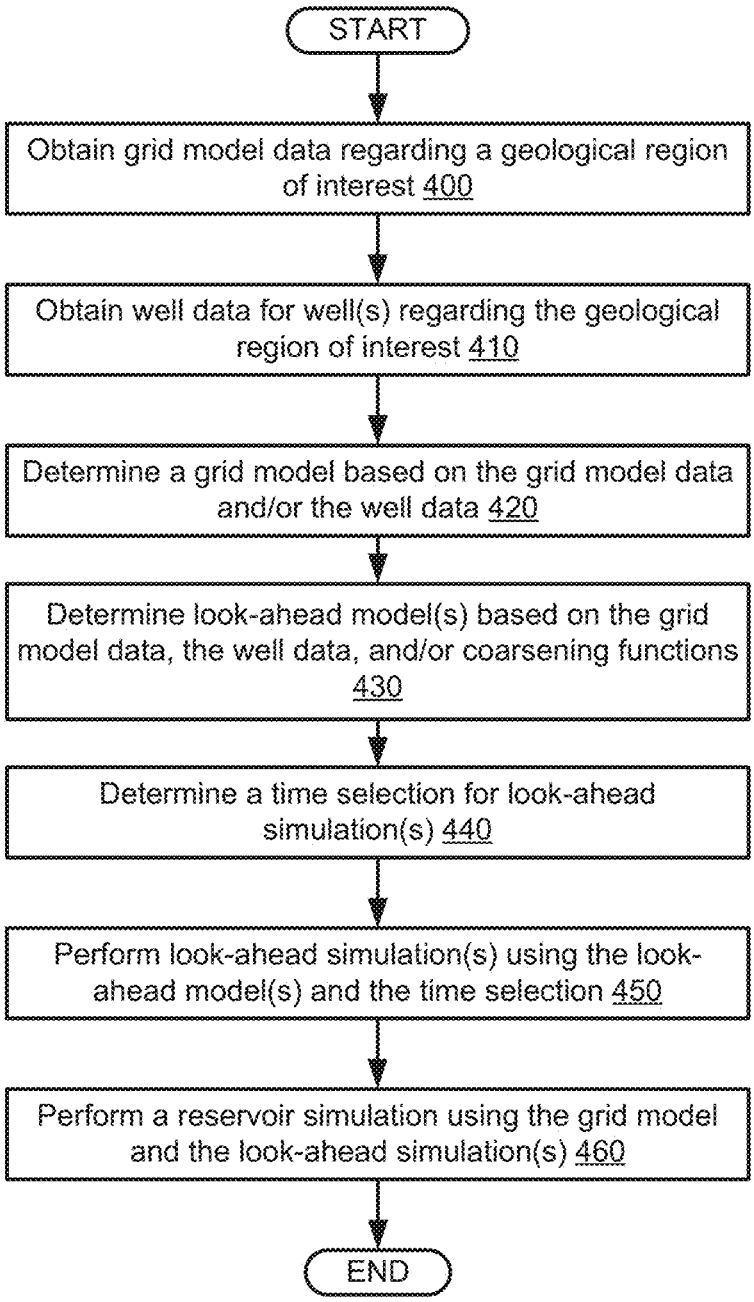
FIG. 4 shows a flowchart in accordance with one or more embodiments.

Turning to FIG. 4, FIG. 4 shows a flowchart in accordance with one or more embodiments. Specifically, FIG. 4 describes a general method for simulating a geological region of interest using one or more look-ahead models. One or more blocks in FIG. 4 may be performed by one or more components (e.g., reservoir simulator (160)) as described in FIGS. 1, 2A, 2B, and 3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, grid model data are obtained regarding a geological region of interest in accordance with one or more embodiments. For example, a reservoir simulator may access model data from a fine-grid model, where the model data includes various reservoir property values, such as oil saturation, water saturation, porosity, permeability, etc. A geological region of interest may be a portion of a geological area or volume that includes one or more wells or formations of interest desired or selected for further analysis, e.g., for determining a location of hydrocarbons or reservoir development purposes for a respective reservoir. As such, a geological region of interest may include one or more reservoir regions selected for running simulations. For example, the geological region of interest may be similar to geological region (200) or reservoir region (230) described above in FIG. 2A and the accompanying description.

In Block 410, well data for one or more wells are obtained regarding a geological region of interest in accordance with one or more embodiments. Well data may correspond to wellhead data described above in FIG. 1 as well as various well design parameters, e.g., type of wellbore, such as a vertical or horizontal well, and/or specific wellbore dimensions. Well data may also include historical production data or historical injection data, such as flow rate data, surface pressure data, etc., or simulated well data from one or more previous reservoir simulations. Well data may also include predicted well data or adjusted well data obtained during a reservoir simulation. For example, a reservoir simulation may attempt to optimize production data for multiple wells in an oil field over a predetermined time period, where the well data may include simulated output data at different time steps in the simulation.

In Block 420, a grid model is determined based on grid model data and/or well data in accordance with one or more embodiments. The grid model may be similar may be similar to a fine-grid model and/or a coarsened-grid model described above in FIG. 2B and the accompanying description.

In Block 430, one or more look-ahead models are determined based on grid model data, well data, and/or one or more coarsening functions in accordance with one or more embodiments. For example, a look-ahead model may be several times faster than the main grid model, i.e. at least 5× to 10× faster. For a look-ahead model that is 10× faster than the grid model, the look-ahead model may simulate ten years for every one year simulated for the grid model. In some embodiments, look-ahead models may be used to perform look-ahead simulations performed in parallel to the main reservoir simulation. Likewise, look-ahead models may be accessed by one or more parallel machines with parallel processors to perform look-ahead simulations.

In some embodiments, a reservoir simulator areally coarsen various cells or blocks within a grid model to produce a look-ahead model. For example, one or more fine-grid regions may have their resolutions preserved around respective wells or important geological features, while other areas may be coarsened accordingly. Coarsening functions may also be based on various data-driven approaches, such as reducing the number of solutions for reservoir equations computed during a particular time step of a simulation. For more information on coarsening functions, see FIG. 2B above and the accompanying description.

In Block 440, a time selection is obtained for one or more look-ahead simulations in accordance with one or more embodiments. In particular, a user may choose one or more time selections within a graphical user interface for look-ahead simulations and/or a reservoir simulation with a grid model. For example, a time selection may specify the starting time, the ending time, and/or a duration time of a look-ahead simulation. In some embodiments, a time selection is computed based on other user input parameters (e.g., as a percentage of a time selection of an entire reservoir simulation). In some embodiments, a reservoir simulator automatically determines a respective time selection based on analyzing simulation parameters during an ongoing reservoir simulation. Moreover, time selections may be based on computing time or the progress of a grid model's reservoir simulation. For example, the look-ahead simulation may end once the primary reservoir simulation achieves a certain milestone or reaches a specific time step.

In some embodiments, a reservoir simulation automatically determines a time selection based on one or more predetermined criteria. For example, the reservoir simulator may determine a time selection for a look-ahead simulation based on the computing speed of simulating a grid model. If the grid model's simulation is very slow, the reservoir simulator may be able to perform a look-ahead simulation for a much later time step. Where multiple look-ahead simulations are being performed, the time selections may be staggered to provide a glimpse of the reservoir simulation across different time periods (e.g., one look-ahead simulation may end at a quarter interval, another simulation may end at a midpoint interval, another simulation may end at the three quarter interval, and another simulation may end at the final time step in the grid model's reservoir simulation).

In Block 450, one or more look-ahead simulations are performed using one or more look-ahead models and a time selection in accordance with one or more embodiments. For example, a look-ahead simulation may be performed in parallel to a running full-field simulation of a geological region of interest. On the other hand, the ongoing reservoir simulation may be paused until one or more look-ahead simulations are completed.

In Block 460, a reservoir simulation is performed using a grid model and one or more look-ahead simulations in accordance with one or more embodiments. After look-ahead simulations are performed, the main grid model may continue to simulate to a predetermined simulation time. Afterwards, a reservoir simulator may collect simulation output (e.g., in a specified form of look-ahead data) regarding the look-ahead simulations. The look-ahead data may be used to condition the grid model in future time steps going forward in the reservoir simulation. This agglomeration of look-ahead data and current simulation data from the grid model may be dependent on the simulation workflow that is being executed.

In some embodiments, various types of reservoir simulations are performed by a reservoir simulator. For example, reservoir simulations may be used for history matching, predicting production rates at one or more wells, and/or determining the presence of hydrocarbon-producing formations for new wells. Likewise, various reservoir simulation applications may be performed, such as rankings, uncertainty analyses, sensitivity analyses, and/or well-by-well history matching. With respect to history matching, the objective may be to fit measured historical data to a reservoir model. In some embodiments, one or more reservoir simulations are used to optimize production for a well or group of wells, provide well design parameters for one or more wells, completion operations for one or more wells (e.g., using which down-hole devices).

Figure 5:
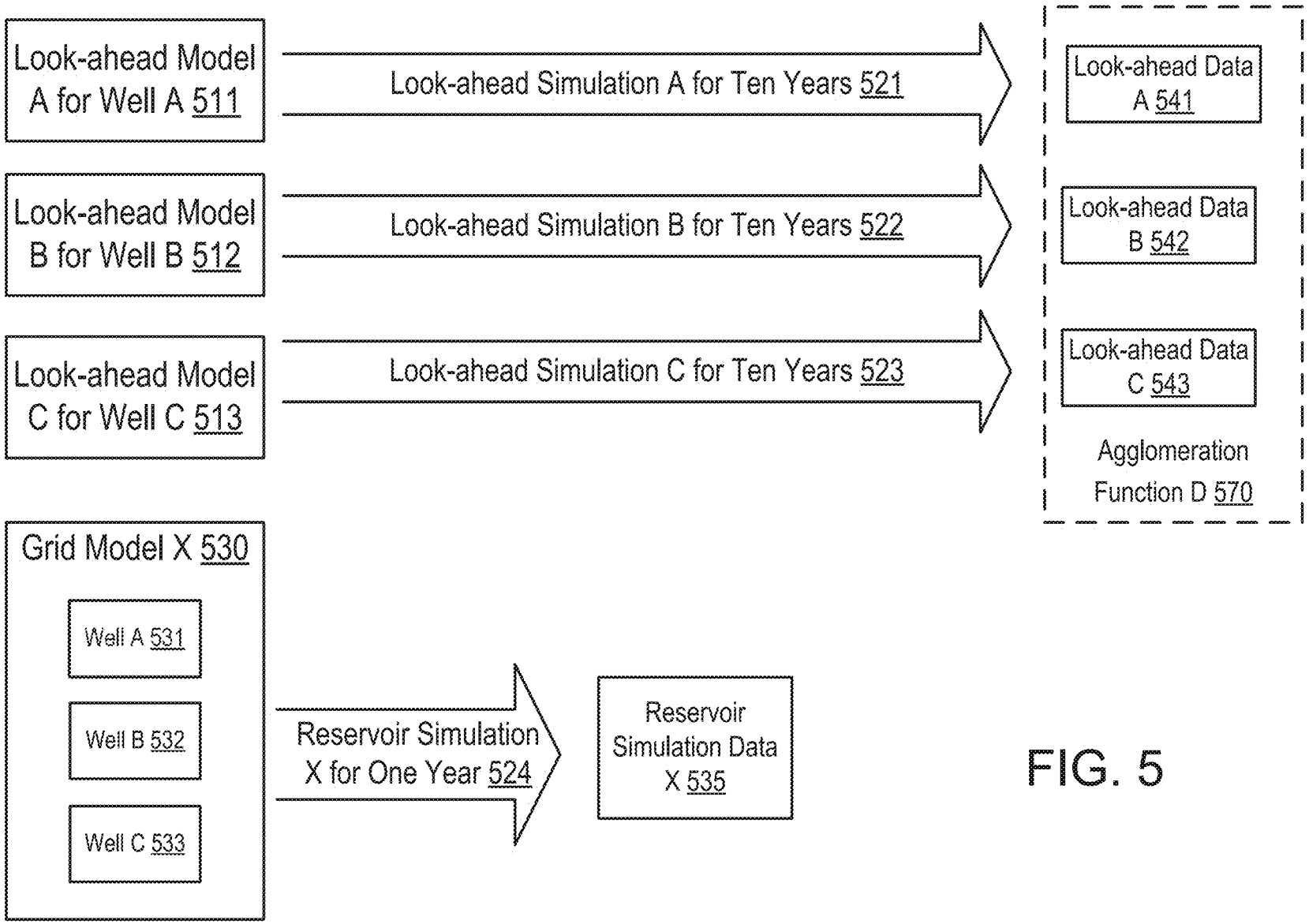
FIGS. 5, 6A, and 6B show examples in accordance with one or more embodiments.

Turning to FIG. 5, FIG. 5 provides an example of using multiple look-ahead models for multiple wells in a reservoir simulation in accordance with one or more embodiments. The following example is for explanatory purposes only and not intended to limit the scope of the disclosed technology. As shown in FIG. 5, a reservoir simulator (not shown) obtains a grid model X (530) that includes grid model data and well data for various wells, i.e., well A (531), well B (532), and well C (533). Using the grid model data and the well data, the reservoir simulator determines various coarsened grid models, i.e., look-ahead model A (511) for well A (531), look-ahead model B (512) for well B (532), and look-ahead model C (513) for well C (533). These look-ahead models (511, 512, 513) are used by the reservoir simulator to perform various look-ahead simulations (i.e., look-ahead simulation A (521) for ten years, look-ahead simulation B (522) for ten years, and look-ahead simulation C (523) for ten years). For illustration, the look-ahead simulations (521, 522, 523) may be performed with the same computer processing time as the reservoir simulation X (524) for one year based on the grid model X (530). After performing the look-ahead simulations (521, 522, 523), look data is subsequently produced, i.e., look-ahead data A (541), look-ahead data B (542), and look-ahead data C (543). The reservoir simulator uses this look-ahead data (541, 542, 543) with reservoir simulation data X (535) produced by the reservoir simulation X (524) and an agglomeration function D (570). Thus, the reservoir simulator may adjust the reservoir simulation based on grid model X (530) for the subsequent time period using the simulation output of both a portion of the total reservoir simulation and various look-ahead simulations.

In some embodiments, a reservoir simulator has a choice over which wells to open for production in-order to maintain certain group targets during the prediction phase of a reservoir simulation. For example, a reservoir simulation may select a particular well based on the production potential at the current time, e.g. the flow of oil that is obtained if the well is operated at the minimum bottom-hole pressure. Thus, one or more candidate wells with the largest production potential may be chosen as the well to open during one or more time steps in a reservoir simulation. Using look-ahead simulations, this well selection procedure may be enhanced accordingly. For example, the number of look-ahead models may be set to the number of candidate wells in the reservoir simulation. Each candidate well may be inserted into a new coarsened look-ahead model. The well selection look-ahead models may be simulated for a time period (i.e., $\Delta L$) where the well can be properly evaluated (e.g., 5-20 years). Likewise, the well selection may include another time period (i.e., $\Delta W$) where the reservoir simulator can simulate a geological region prior to the candidate wells needing to flow or provide production. This time period prior to flowing may be a short period of time, such as one year or less.

Keeping with look-ahead simulations based on well selections, the look-ahead models may be coarsened outside an area of interest around respective candidate wells. For example, by maintaining a predetermined level of resolution around the candidate wells in the coarsened grid model, look-ahead simulations may also maintain a predetermined level of accuracy. Using an agglomeration function, for example, a reservoir simulation may determine the performance for each candidate well from look-ahead data, such as to choose the candidate well with the greatest cumulative oil production during the reservoir simulation. Additionally, because the look-ahead models may include various well constraints and actions similar to the main grid model, the production potential of the entire oil field may be a better choice to evaluate how different well scenarios increase the performance of the entire grid model.

Figure 6A:
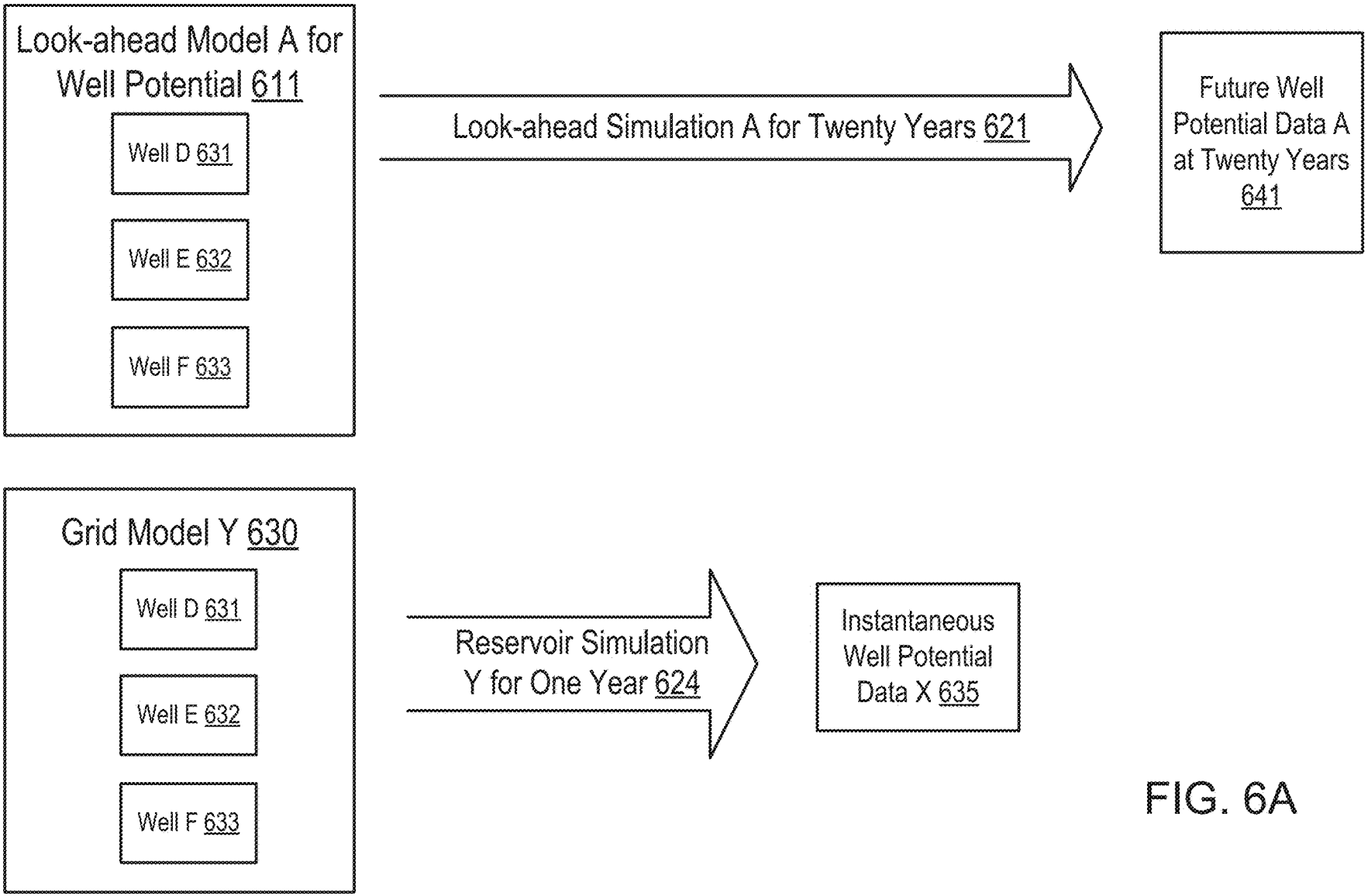
Figure 6B:
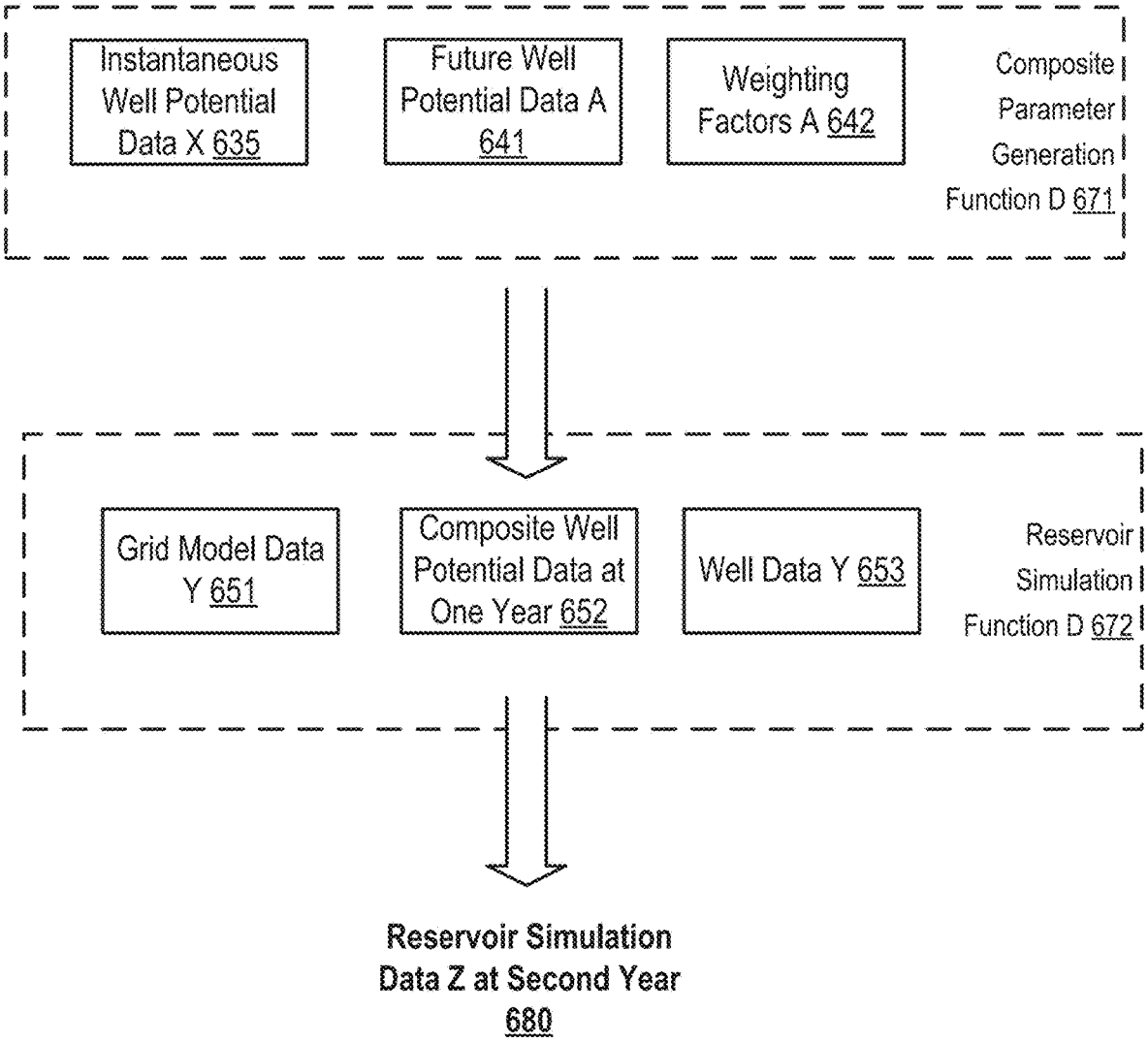

Turning to FIGS. 6A and 6B, FIGS. 6A and 6B provide an example of using a look-ahead model for optimizing well potential in a reservoir simulation in accordance with one or more embodiments. The following example is for explanatory purposes only and not intended to limit the scope of the disclosed technology. As shown in FIG. 6A, a reservoir simulator (not shown) obtains a grid model Y (630) that includes grid model data and well data for various wells, i.e., well D (631), well E (632), and well F (633). Using the grid model data and the well data, the reservoir simulator determines a single coarsened grid model, i.e., look-ahead model A (611) for well potential of the wells (631, 632, 633). The reservoir simulator then performs a look-ahead simulation A (621) for twenty years using the look-ahead model A (611) to determine future well potential data A (641) at twenty years. Likewise, the reservoir simulator also determines instantaneous well potential data X (635) using a reservoir simulation Y (624) for one year based on the grid model Y (630).

Turning to FIG. 6B, the reservoir simulator applies a composite parameter generation function D (671) using various inputs, i.e., instantaneous well potential data X (635), future well potential data A (641), and various weight factors A (642). For example, the weighting factors A (642) may weight individual well potentials of respective wells in both the reservoir simulation Y (624) and the look-ahead simulation A (621). As such, the output of the composite parameter generation function D (671) is composite well potential data (652) at one year in the reservoir simulation. Using the reservoir simulation function D (672), the reservoir simulator then uses the grid model data Y (651) and well data Y (653) to perform another reservoir simulation for the next time step, i.e., to produce reservoir simulation data Z (680) at the second year of the simulation.

In some embodiments, a reservoir simulator uses look-ahead simulations to perform a plateau optimization. During the prediction phase of the main reservoir simulation, an entire field may be given a target production rate that is done by adding up the contribution of various wells in the field. As such, the amount of time that this production target can be maintained may be referred to as the "plateau time." By using a reservoir simulator, how long a field may maintain a given target plateau production rate may be determined accordingly. In a well management system within a reservoir simulator, respective well productions may be allocated in order to reach that target plateau. This may involve assigning a well potential $$\text{(i.e., } \gamma_i^{t*}\text{)}$$

for each well i at each simulation time step t. A well with high potential may thus contribute more to the group target than wells with low well potential. Well potentials may be determined in many ways to account for oil production rate and other factors (e.g., penalizing wells that produce a lot of water and gas). In some embodiments, the well production potential is evaluated at the current simulation time t, i.e. the instantaneous well potential, as well as future simulation times using look-ahead simulations.

Furthermore, a composite well potential may be used in a reservoir simulation that is based on the instantaneous well potential at a particular time step and one or more well potentials determined by various look-ahead simulations. In some embodiments, a composite well potential is expressed using the following equation:

$$\gamma_i^{t*} = \omega\ \gamma_i^{t,m} + (1-\omega)\gamma_i^{t+\Delta F,c} \qquad \text{Equation 1}$$

where $$\gamma_i^{t*}$$

is the composite well potential that is used in the well management system for reservoir simulations based on a main grid model, $$\gamma_i^{t,m}$$

is the instantaneous well potential for well i is determined by the main grid model at the current time $$t,\ \gamma_i^{t+\Delta F,c}$$

is the future well potential of well i based on one or more look-ahead simulations for time t+ΔF, ΔF is the time increment for the future delta (e.g., twenty years in FIGS. 6A-6B), ω is a weighting factor such that 1 is a composite well potential based only on simulations from the main grid model and 0 is a composite well potential based only on look-ahead simulations. By weighting the instantaneous well potential of each well with an approximation of future well performance, wells that are currently good and remain good into the future may contribute to the current field target more than wells that have problems in the future. Thus, good future wells may contribute more to the plateau target.

Figure 7:
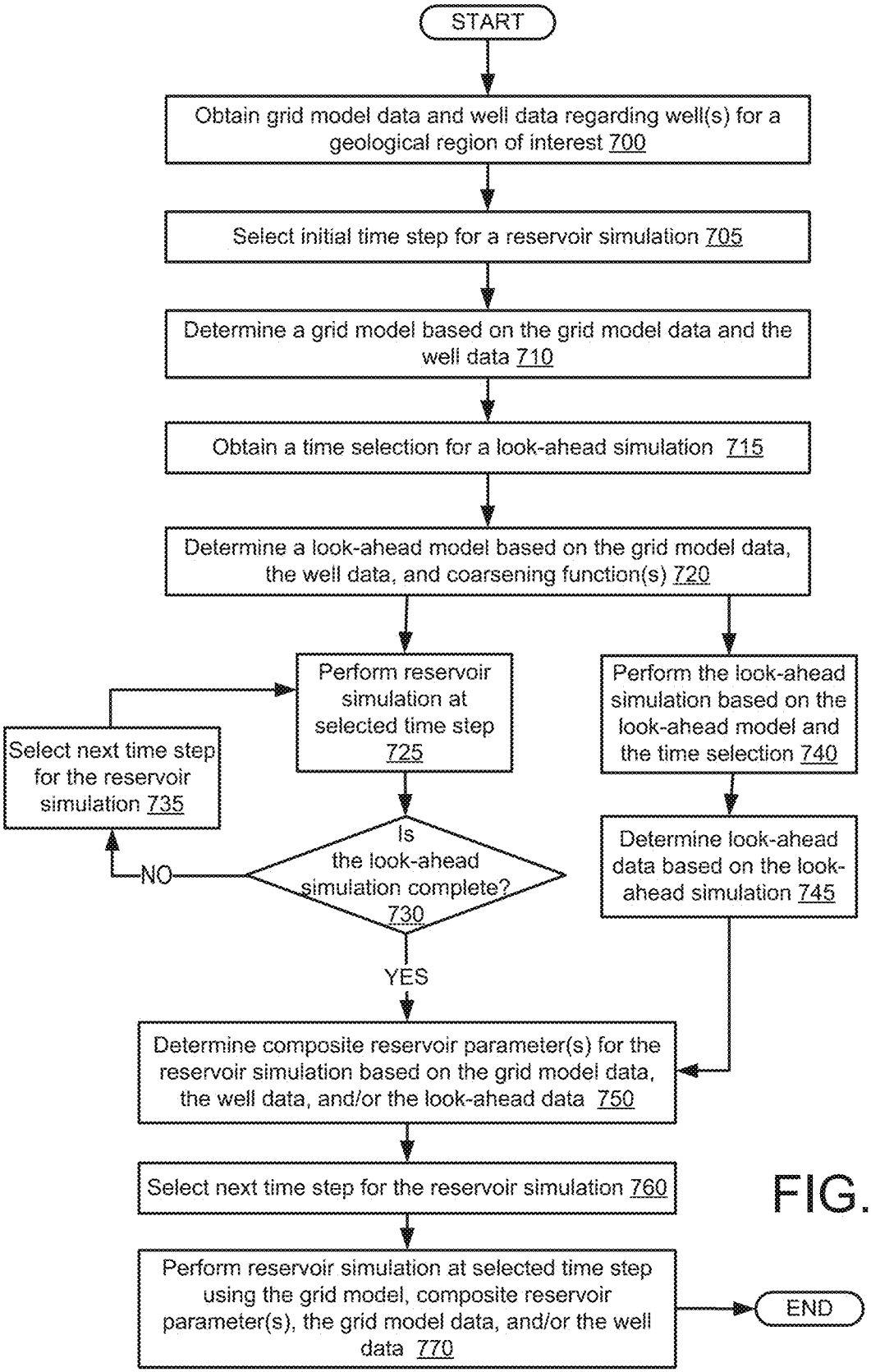
FIG. 7 shows a flowchart in accordance with one or more embodiments.

Turning to FIG. 7, FIG. 7 shows a flowchart in accordance with one or more embodiments. Specifically, FIG. 7 describes a specific method for simulating a geological region of interest using look-ahead simulations in parallel with a reservoir simulation. One or more blocks in FIG. 7 may be performed by one or more components (e.g., reservoir simulator (160)) as described in FIGS. 1, 2A, 2B, and 3. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 700, grid model data and well data regarding one or more wells are obtained for a geological region of interest in accordance with one or more embodiments.

In Block 705, an initial time step is selected for a reservoir simulation in accordance with one or more embodiments.

In Block 710, a grid model is determined based on grid model data and well data in accordance with one or more embodiments.

In Block 715, a time selection is obtained for a look-ahead simulation in accordance with one or more embodiments.

In Block 720, a look-ahead model is determined based on grid model data, well data, and one or more coarsening functions in accordance with one or more embodiments.

In Block 725, a reservoir simulation is performed at a selected time step in accordance with one or more embodiments.

In Block 730, a determination is made whether a look-ahead simulation is complete in accordance with one or more embodiments. Where a determination is made a look-ahead simulation is still being performed, the process shown in FIG. 7 may proceed to Block 735. Where a determination is made that the look-ahead simulation is complete, the process shown in FIG. 7 may proceed to Block 750.

In Block 735, a next time step is selected for a reservoir simulation in accordance with one or more embodiments.

In Block 740, a look-ahead simulation is performed based on a look-ahead model and a time selection in accordance with one or more embodiments.

In Block 745, look-ahead data are determined based on a look-ahead simulation in accordance with one or more embodiments.

In Block 750, one or more composite reservoir parameters are determined for a reservoir simulation based on grid model data, well data, and/or look-ahead data in accordance with one or more embodiments.

In Block 760, a next time step is selected for a reservoir simulation in accordance with one or more embodiments.

In Block 770, a reservoir simulation is performed at a selected time step using a grid model, one or more composite reservoir parameters, grid model data, and/or well data in accordance with one or more embodiments.

Figure 8A:
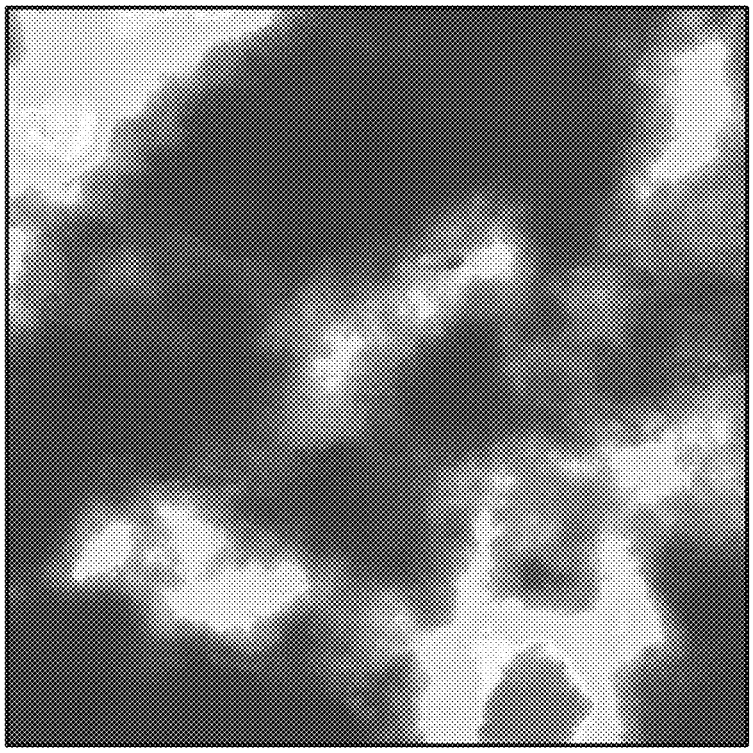
FIGS. 8A, 8B, 8C, 8D, 8E, 8F, 8G, and 8H show examples in accordance with one or more embodiments.
Figure 8B:
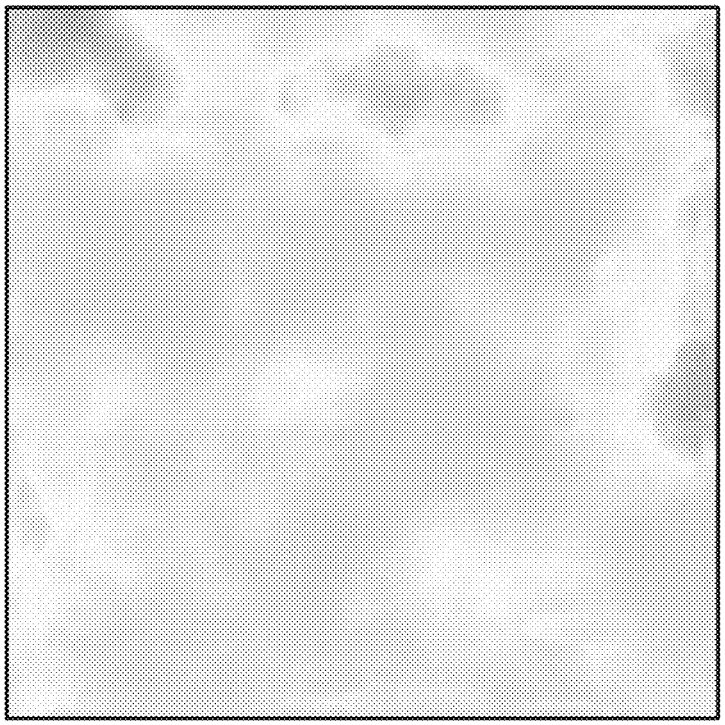
Figure 8C:
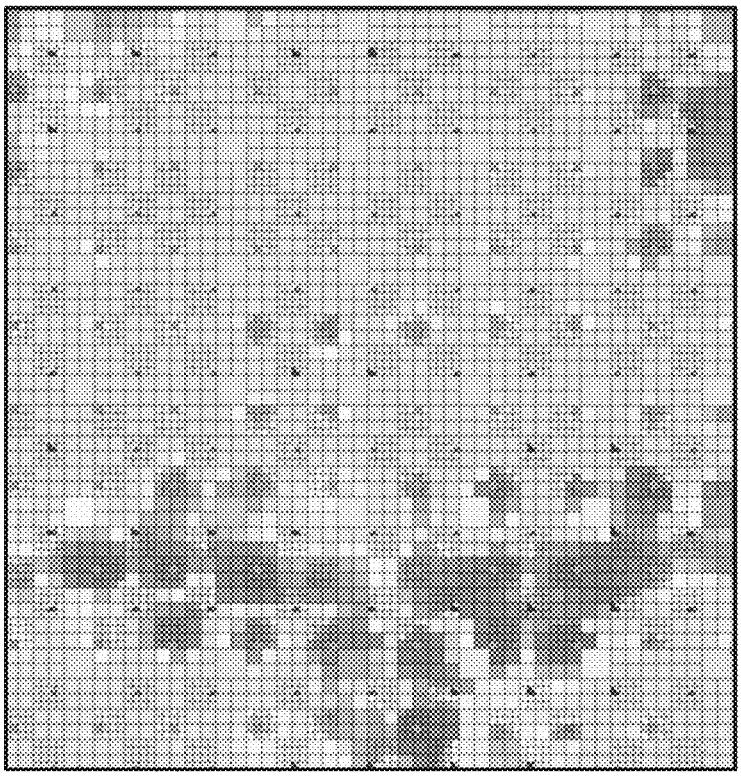
Figure 8D:
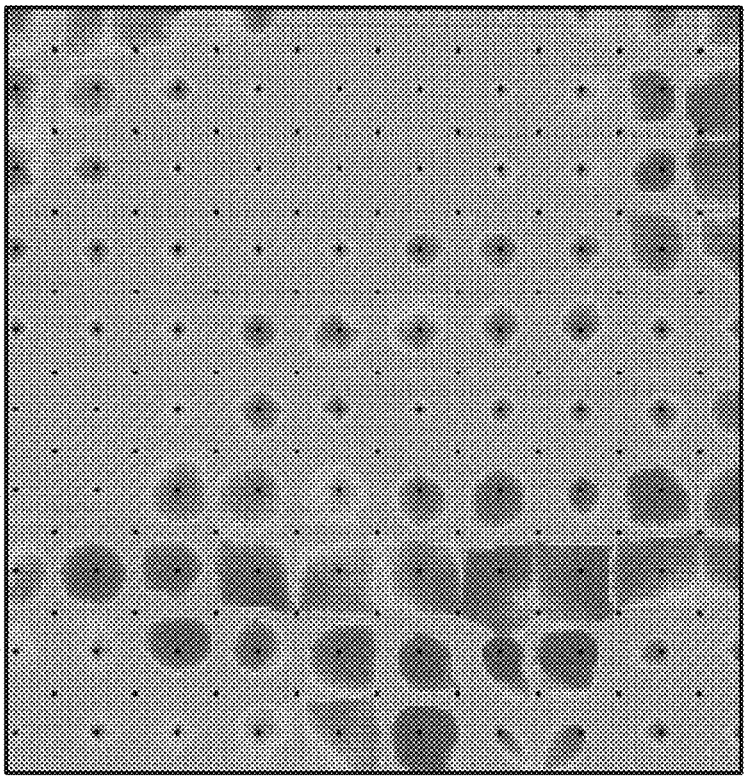

Turning to FIGS. 8A-8H, FIGS. 8A-8H provide an example of using look-ahead simulations for plateau optimization. In particular, a grid model may be a 201×201×10 model with 404010 active cells, a 100 m grid size in DX, and a DY with 1 ft DZ grid size. The grid model may include a fluid model with a black-oil fluid system (e.g., oil, water, gas). A reservoir simulation for the grid model may include 200 wells with 100 production wells and 100 injector wells arranged in a 5 spot pattern as shown in FIG. 8D. Permeability in the grid model may be heterogeneous, where some layers are shown in FIG. 8A. FIG. 8B shows a porosity map of the same geological region. The grid of a look-ahead model can be seen in FIG. 8D and compared with the main grid model in FIG. 8C. The look-ahead model in FIG. 8C has 47010 active cells, which is a 0.116 reduction of cells in comparison to the main grid model in FIG. 8D. Reservoir simulations and look-ahead simulations are run on 10 cores on a parallel cluster.

Figure 8E:
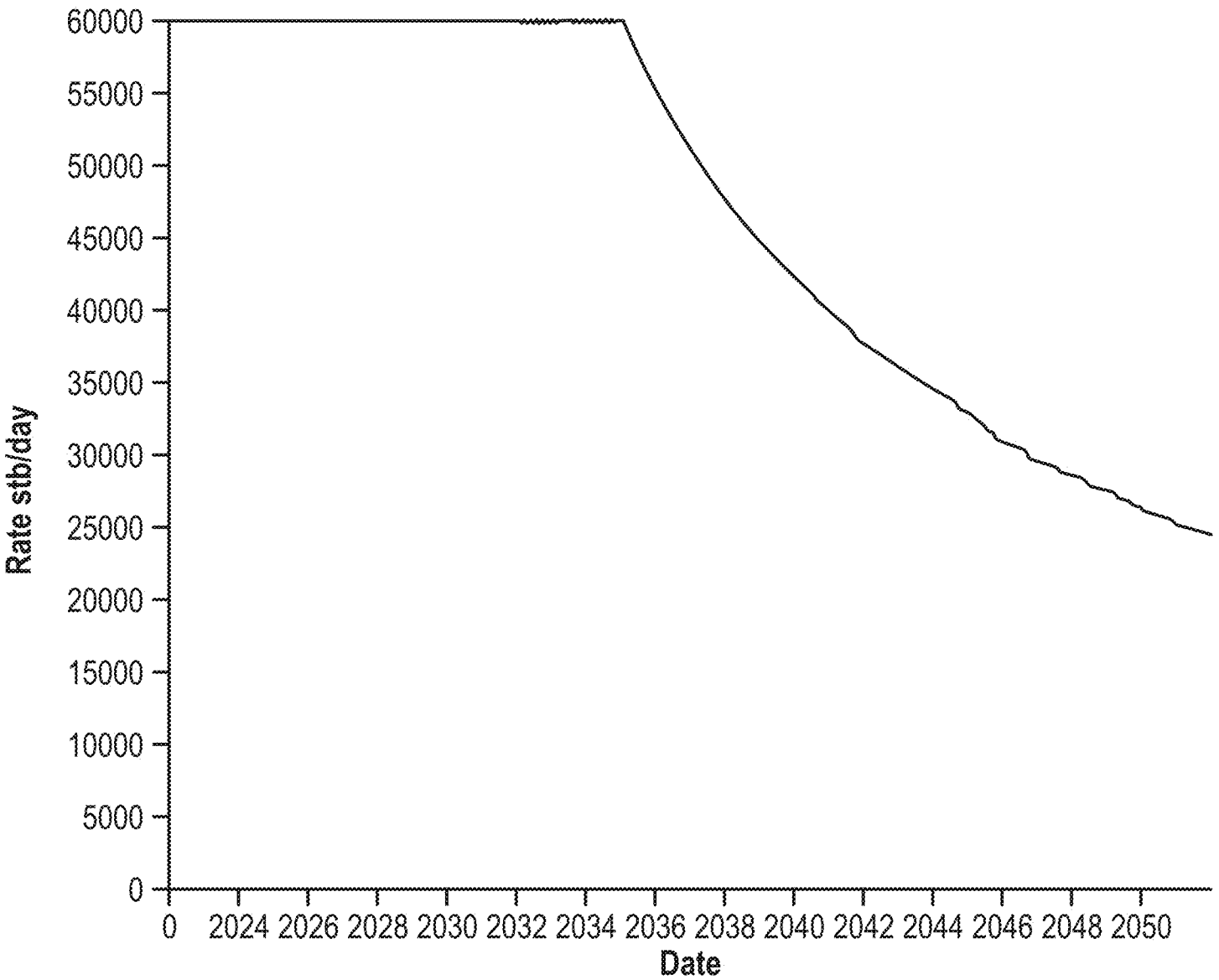
Figure 8F:
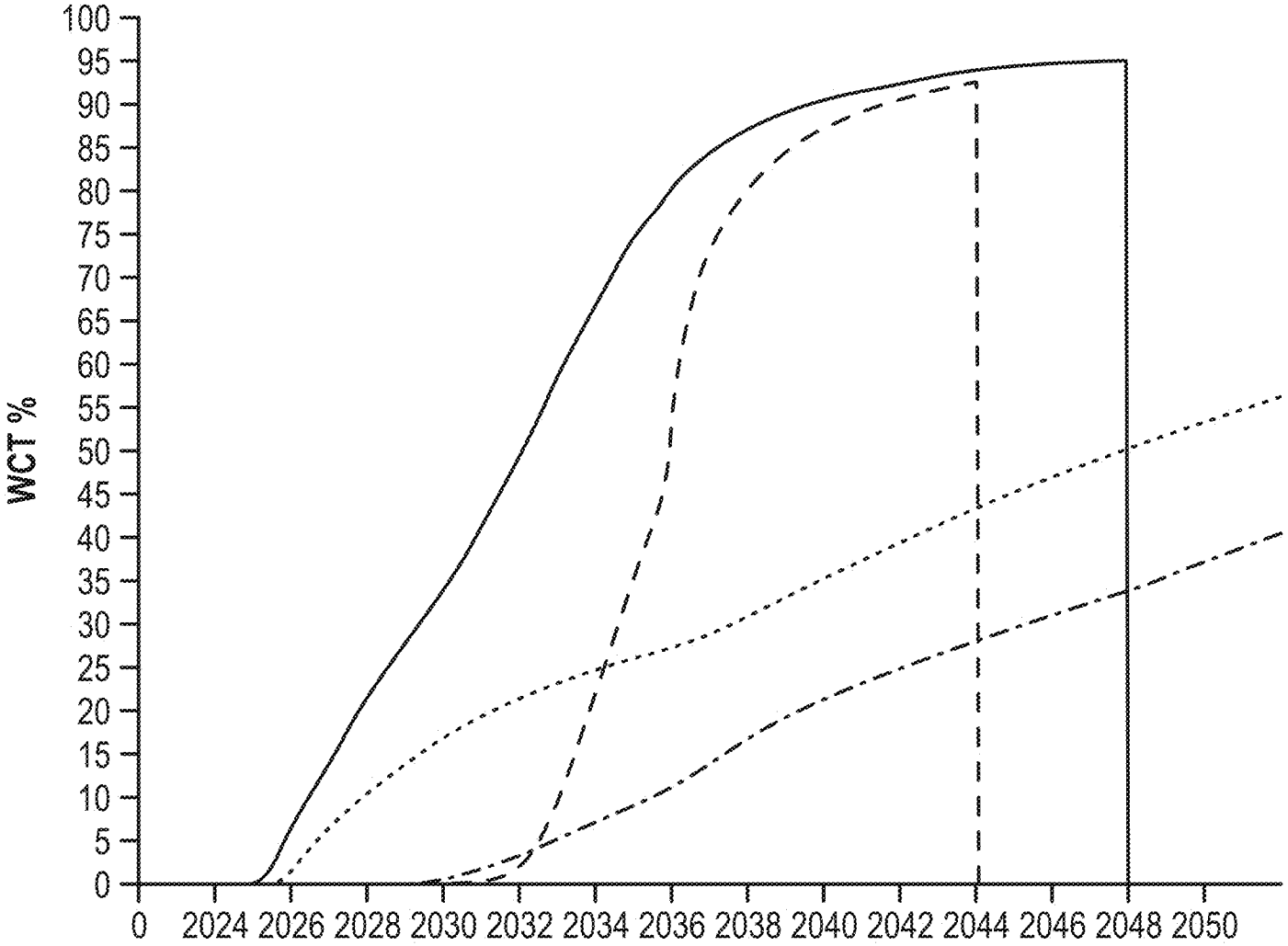
Figure 8G:
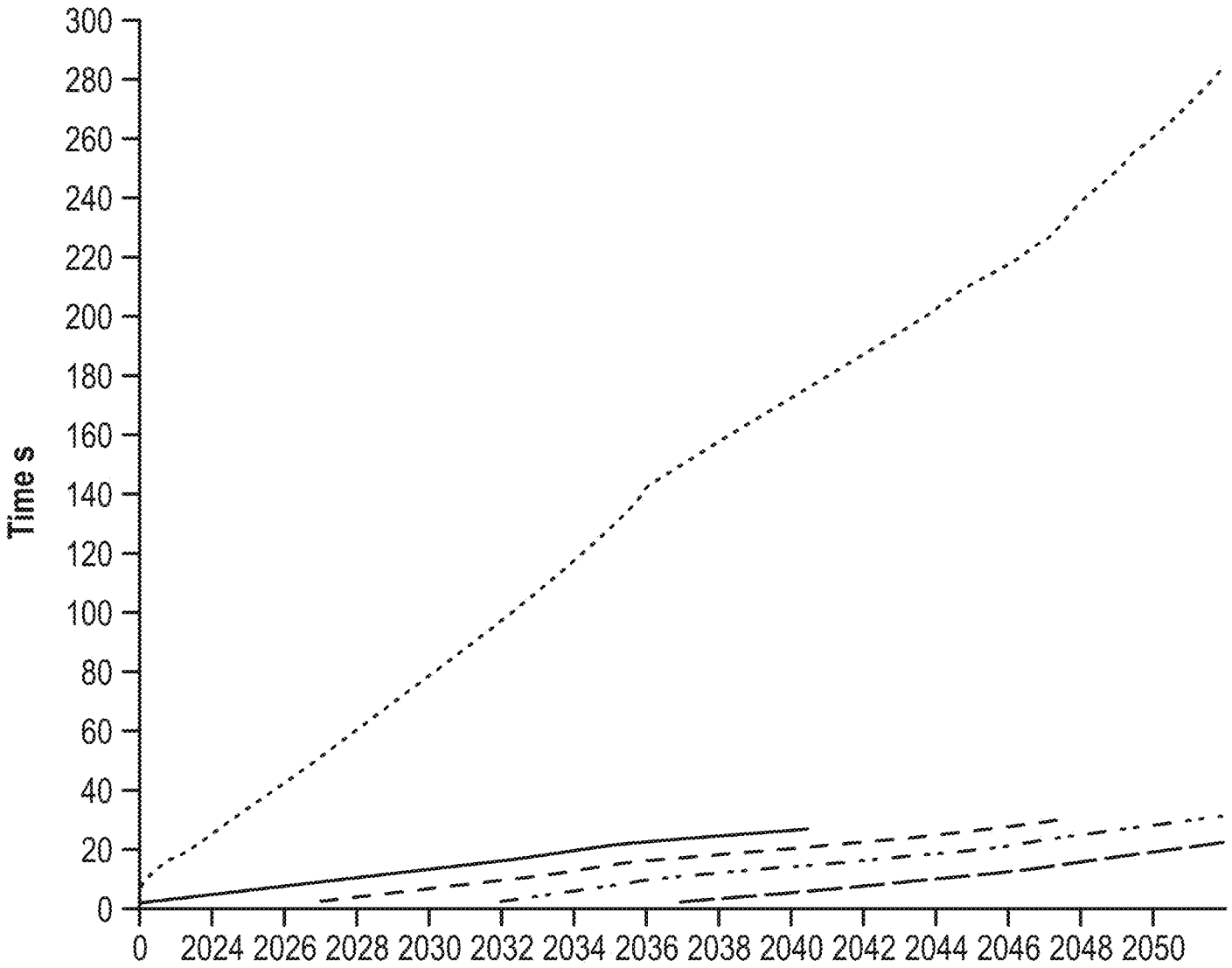
Figure 8H:
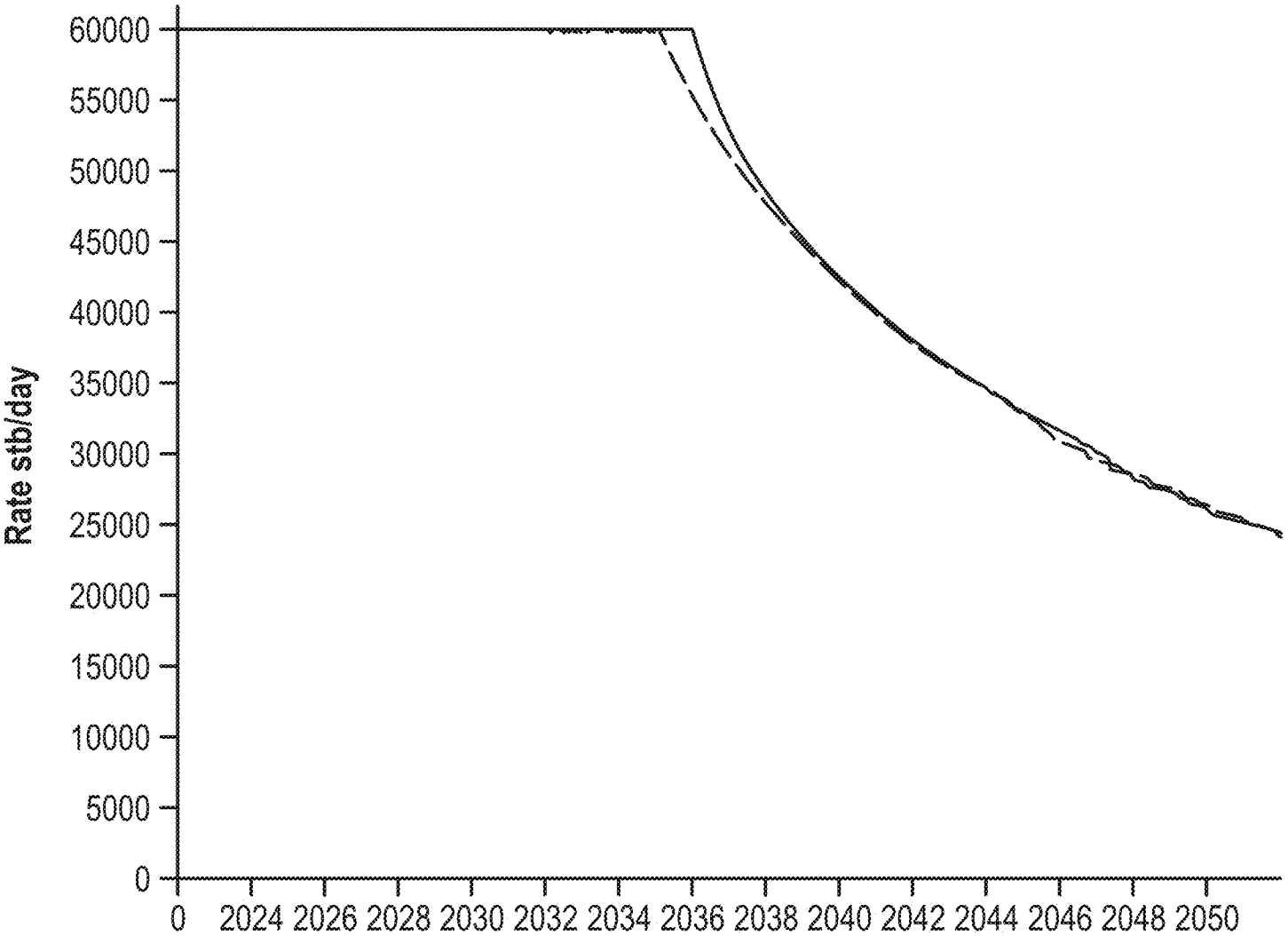

Turning to FIGS. 8C-8E, FIG. 8C shows a water saturation map and grid for LAM model (after 10 years of prediction)-red indicates high water saturation. On the other hand, FIG. 8D shows a water saturation map and grid for a main grid model, where the wells are the dots after 10 years of prediction. FIG. 8E illustrates two groups, i.e., a group of 100 producers with a plateau target of 60000 bb/day, while a group of 100 injectors which replace the fluid void from production in the reservoir, i.e. the injected fluid is equal to the produced fluid at reservoir conditions. For well constraints, each production well may have a liquid rate limit and a minimum bottom hole pressure constraint, and each injection well may have a maximum bottom hole pressure constraint and a water injection limit. Likewise, some well constraints may include well rules to shut wells when the respective well becomes uneconomic. Another well rule may include a shut-in rule that triggers if a production well's water cut exceeds 90% or the potential production rate becomes less than 200 bb/day. The effect of these well rules can be seen in FIGS. 8F and 8G. FIG. 8F illustrates water-cut values for all production wells, while FIG. 8G illustrates oil rates for all production wells (i.e., different line types, such as solid lines and segmented lines, correspond to different wells in FIGS. 8F and 8G). FIG. 8E shows the oil production rate for the entire field, where a plateau is observed until 1 Feb. 2035. FIG. 8H shows the difference between simulations based on a main grid model and simulations based on various look-ahead models.

Furthermore, the water breakthrough time (i.e., the time for the injection water to reach production wells) is between 5-15 years as shown in FIG. 8F. Hence to make a significant difference, the look-ahead simulations need to differentiate between a well that waters out in 1 years' time and another well that waters out in 10 years' time. By doing so, wells that water out sooner may be allocated (e.g., through Equation 1 above) with a lower well potential and will be allocated less production within the plateau, and thus delay breakthroughs. If instantaneous well potential is used, the well allocation may not differentiate between wells with future problems in the absence of look-ahead simulations.

Figure 9:
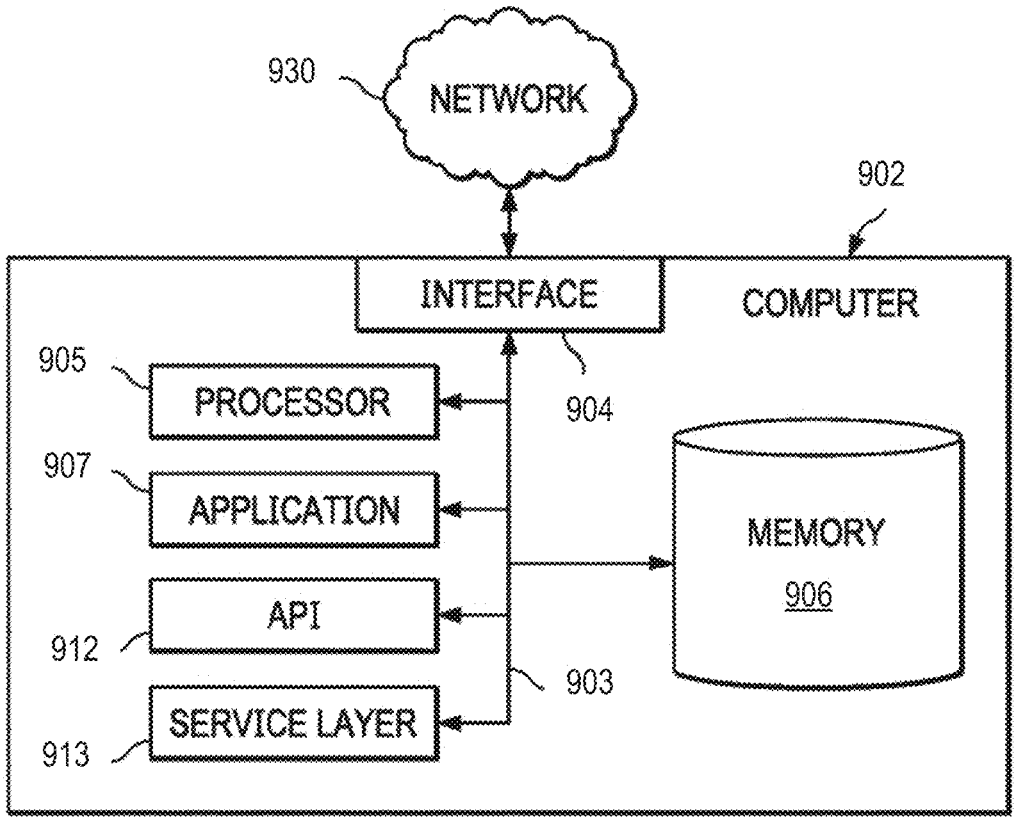
FIG. 9 shows a computer system in accordance with one or more embodiments.

Embodiments may be implemented on a computer system. FIG. 9 is a block diagram of a computer system (902) used to provide computational functionalities associated with described algorithms, methods, functions, processes, flows, and procedures as described in the instant disclosure, according to an implementation. The illustrated computer (902) is intended to encompass any computing device such as a high performance computing (HPC) device, server, desktop computer, laptop/notebook computer, wireless data port, smart phone, personal data assistant (PDA), tablet computing device, one or more computer processors within these devices, or any other suitable processing device, including both physical or virtual instances (or both) of the computing device. Additionally, the computer (902) may include a computer that includes an input device, such as a keypad, keyboard, touch screen, or other device that can accept user information, and an output device that conveys information associated with the operation of the computer (902), including digital data, visual, or audio information (or a combination of information), or a GUI.

The computer (902) can serve in a role as a client, network component, a server, a database or other persistency, or any other component (or a combination of roles) of a computer system for performing the subject matter described in the instant disclosure. The illustrated computer (902) is communicably coupled with a network (930). In some implementations, one or more components of the computer (902) may be configured to operate within environments, including cloud-computing-based, local, global, or other environment (or a combination of environments).

At a high level, the computer (902) is an electronic computing device operable to receive, transmit, process, store, or manage data and information associated with the described subject matter. According to some implementations, the computer (902) may also include or be communicably coupled with an application server, e-mail server, web server, caching server, streaming data server, business intelligence (BI) server, or other server (or a combination of servers).

The computer (902) can receive requests over network (930) from a client application (for example, executing on another computer (902)) and responding to the received requests by processing the said requests in an appropriate software application. In addition, requests may also be sent to the computer (902) from internal users (for example, from a command console or by other appropriate access method), external or third-parties, other automated applications, as well as any other appropriate entities, individuals, systems, or computers.

Each of the components of the computer (902) can communicate using a system bus (903). In some implementations, any or all of the components of the computer (902), both hardware or software (or a combination of hardware and software), may interface with each other or the interface (904) (or a combination of both) over the system bus (903) using an application programming interface (API) (912) or a service layer (913) (or a combination of the API (912) and service layer (913). The API (912) may include specifications for routines, data structures, and object classes. The API (912) may be either computer-language independent or dependent and refer to a complete interface, a single function, or even a set of APIs. The service layer (913) provides software services to the computer (902) or other components (whether or not illustrated) that are communicably coupled to the computer (902). The functionality of the computer (902) may be accessible for all service consumers using this service layer. Software services, such as those provided by the service layer (913), provide reusable, defined business functionalities through a defined interface. For example, the interface may be software written in JAVA, C++, or other suitable language providing data in extensible markup language (XML) format or other suitable format. While illustrated as an integrated component of the computer (902), alternative implementations may illustrate the API (912) or the service layer (913) as stand-alone components in relation to other components of the computer (902) or other components (whether or not illustrated) that are communicably coupled to the computer (902). Moreover, any or all parts of the API (912) or the service layer (913) may be implemented as child or sub-modules of another software module, enterprise application, or hardware module without departing from the scope of this disclosure.

The computer (902) includes an interface (904). Although illustrated as a single interface (904) in FIG. 9, two or more interfaces (904) may be used according to particular needs, desires, or particular implementations of the computer (902). The interface (904) is used by the computer (902) for communicating with other systems in a distributed environment that are connected to the network (930). Generally, the interface (904 includes logic encoded in software or hardware (or a combination of software and hardware) and operable to communicate with the network (930). More specifically, the interface (904) may include software supporting one or more communication protocols associated with communications such that the network (930) or interface's hardware is operable to communicate physical signals within and outside of the illustrated computer (902).

The computer (902) includes at least one computer processor (905). Although illustrated as a single processor (905) in FIG. 9, two or more computer processors may be used according to particular needs, desires, or particular implementations of the computer (902). Generally, the computer processor (905) executes instructions and manipulates data to perform the operations of the computer (902) and any algorithms, methods, functions, processes, flows, and procedures as described in the instant disclosure.

The computer (902) also includes a memory (906) that holds data for the computer (902) or other components (or a combination of both) that can be connected to the network (930). For example, memory (906) can be a database storing data consistent with this disclosure. Although illustrated as a single memory (906) in FIG. 9, two or more memories may be used according to particular needs, desires, or particular implementations of the computer (902) and the described functionality. While memory (906) is illustrated as an integral component of the computer (902), in alternative implementations, memory (906) can be external to the computer (902).

The application (907) is an algorithmic software engine providing functionality according to particular needs, desires, or particular implementations of the computer (902), particularly with respect to functionality described in this disclosure. For example, application (907) can serve as one or more components, modules, applications, etc. Further, although illustrated as a single application (907), the application (907) may be implemented as multiple applications (907) on the computer (902). In addition, although illustrated as integral to the computer (902), in alternative implementations, the application (907) can be external to the computer (902).

There may be any number of computers (902) associated with, or external to, a computer system containing computer (902), each computer (902) communicating over network (930). Further, the term "client," "user," and other appropriate terminology may be used interchangeably as appropriate without departing from the scope of this disclosure. Moreover, this disclosure contemplates that many users may use one computer (902), or that one user may use multiple computers (902).

In some embodiments, the computer (902) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining grid model data regarding a geological region of interest;

obtaining well data regarding one or more wells in the geological region of interest;

obtaining a grid model for the geological region of interest based on the grid model data and the well data;

obtaining a time selection for a first look-ahead simulation among a first plurality of look-ahead simulations;

determining, by a reservoir simulator comprising a central processing unit, a first look-ahead model for the first look-ahead simulation based on the grid model data, the well data, and a first coarsening function, wherein the first look-ahead model simulates the geological region of interest at a faster rate than the grid model;

performing, by the reservoir simulator, the first look-ahead simulation using the first look-ahead model, a first parallel processor among a plurality of parallel processors, and the time selection;

determining, by the reservoir simulator, look-ahead data based on the first look-ahead simulation;

determining, by the reservoir simulator, a composite reservoir parameter based on the well data and the look-ahead data, wherein the composite reservoir parameter comprises a weighted value based on a number of the first plurality of look-ahead simulations; and performing, by the reservoir simulator, a first reservoir simulation of the geological region of interest using the grid model, a second parallel processor among the plurality of parallel processors, and the first look-ahead simulation, wherein the first reservoir simulation and the first look-ahead simulation are performed concurrently using the first parallel processor and the second parallel processor.

2. The method of claim 1, further comprising:

determining, at a first time step in an iterative process, a first well potential for a plurality of wells in the geological region of interest;

determining a second well potential for the plurality of wells using the first look-ahead simulation, wherein the first well potential describes a simulated production rate for the plurality of wells for the first time step, and wherein the second well potential describes a simulated production rate for the plurality of wells over the time selection; and determining a composite well potential based on the first well potential and the second well potential, wherein the first reservoir simulation is performed using the composite well potential.

3. The method of claim 1, further comprising:

determining a plurality of look-ahead models for a plurality of wells in the geological region of interest, wherein a respective look-ahead model among the plurality of look-ahead models corresponds to a respective well among the plurality of wells, wherein the respective look-ahead model comprises an area of interest around the respective well, and wherein the respective look-ahead model comprises a first subset of cells outside the area of interest with greater coarsening than a second subset of cells within the area of interest; and performing a second reservoir simulation based on a second plurality of look-ahead simulations using the plurality of look-ahead models.

4. The method of claim 1, further comprising:

simulating the geological region of interest using a plurality of reservoir simulations comprising the first reservoir simulation, wherein simulating the geological region of interest corresponds to a predetermined time period, and wherein the time selection is a subset of the predetermined time period that is less than the predetermined time period.

5. The method of claim 1, wherein the time selection comprises a target time, wherein the target time corresponds to a predetermined time step in an iterative process where the first look-ahead simulation ends, and wherein the first reservoir simulation continues in the iterative process past the predetermined time step.

6. The method of claim 1, wherein the first look-ahead simulation is performed before beginning the first reservoir simulation.

7. The method of claim 1, further comprising:

determining a second look-ahead model for a second look-ahead simulation based on the grid model data, the well data, and a second coarsening function; and performing the second look-ahead simulation in parallel with the first look-ahead simulation using the second look-ahead model and the time selection, wherein the first coarsening function and second coarsening functions are different functions.

8. The method of claim 1, wherein the first coarsening function is selected from a group consisting of a fluid characterization coarsening, a streamline coarsening, or a grid coarsening.

9. The method of claim 1, wherein the first look-ahead model is a proxy model comprising a plurality of well constraints that are the same as the grid model, and wherein the proxy model has a first plurality of grid cells that are less than a second plurality of grid cells in the grid model.

10. A system, comprising:

a network comprising a plurality of parallel processors, wherein the plurality of parallel processors comprise a first parallel processor and a second parallel processor, and a reservoir simulator comprising a central processing unit (CPU), wherein the reservoir simulator is coupled to the network, the reservoir simulator being configured to perform a method comprising:

obtaining grid model data regarding a geological region of interest;

obtaining well data regarding one or more wells in the geological region of interest;

obtaining a grid model for the geological region of interest based on the grid model data and the well data;

obtaining a time selection for a look-ahead simulation among a first plurality of look-ahead simulations;

determining a look-ahead model for the look-ahead simulation based on the grid model data, the well data, and a first coarsening function, wherein the look-ahead model simulates the geological region of interest at a faster rate than the grid model;

performing the look-ahead simulation using the look-ahead model, the first parallel processor, and the time selection;

determining, by the reservoir simulator, look-ahead data based on the look-ahead simulation;

determining, by the reservoir simulator, a composite reservoir parameter based on the well data and the look-ahead data, wherein the composite reservoir parameter comprises a weighted value based on a number of the first plurality of look-ahead simulations; and performing a first reservoir simulation of the geological region of interest using the grid model, the second parallel processor, and the look-ahead simulation, wherein the first reservoir simulation and the look-ahead simulation are performed concurrently using the first parallel processor and the second parallel processor.

11. The system of claim 10, wherein the method further comprises:

determining, at a time step in an iterative process, a first well potential for a plurality of wells in the geological region of interest;

determining a second well potential for the plurality of wells using the look-ahead simulation, wherein the first well potential describes a simulated production rate for the plurality of wells for the time step, and wherein the second well potential describes a simulated production rate for the plurality of wells over the time selection; and determining a composite well potential based on the first well potential and the second well potential, wherein the first reservoir simulation is performed using the composite well potential.

12. The system of claim 10, wherein the method further comprises:

determining a plurality of look-ahead models for a plurality of wells in the geological region of interest, wherein a respective look-ahead model among the plurality of look-ahead models corresponds to a respective well among the plurality of wells, wherein the respective look-ahead model comprises an area of interest around the respective well, and wherein the respective look-ahead model comprises a first subset of cells outside the area of interest with greater coarsening than a second subset of cells within the area of interest; and performing a second reservoir simulation based on a second plurality of look-ahead simulations using the plurality of look-ahead models.

13. The system of claim 10, wherein the time selection comprises a target time, wherein the target time corresponds to a predetermined time step in an iterative process where the look-ahead simulation ends, and wherein the first reservoir simulation continues in the iterative process past the predetermined time step.

14. The system of claim 10, wherein the network is a parallel cluster comprising a plurality of graphical processing units (GPUs).

15. A non-transitory computer readable medium storing instructions executable by a computer processor, the instructions being configured to perform a method comprising:

obtaining grid model data regarding a geological region of interest;

obtaining well data regarding one or more wells in the geological region of interest;

obtaining a grid model for the geological region of interest based on the grid model data and the well data;

obtaining a time selection for a look-ahead simulation among a plurality of look-ahead simulations;

determining a look-ahead model for the look-ahead simulation based on the grid model data, the well data, and a coarsening function, wherein the look-ahead model simulates the geological region of interest at a faster rate than the grid model;

performing the look-ahead simulation using the look-ahead model, a first parallel processor among a plurality of parallel processors, and the time selection;

determining look-ahead data based on the first look-ahead simulation;

determining a composite reservoir parameter based on the well data and the look-ahead data, wherein the composite reservoir parameter comprises a weighted value based on a number of the first plurality of look-ahead simulations; and performing a first reservoir simulation of the geological region of interest using the grid model, a second parallel processor among the plurality of parallel processors, and the look-ahead simulation, wherein the first reservoir simulation and the first look-ahead simulation are performed concurrently using the first parallel processor and the second parallel processor.

* * * * *